US007361249B2

(12) United States Patent
Haga et al.

(10) Patent No.: US 7,361,249 B2
(45) Date of Patent: Apr. 22, 2008

(54) APPARATUS FOR APPLYING A REMOVABLE COVER TO A TICKET SUBSTRATE

(75) Inventors: Matthew Howard Haga, Austin, TX (US); Danny E. Swindler, Round Rock, TX (US)

(73) Assignee: Multimedia Games, Inc., Austin, TX (US)

( * ) Notice: Subject to any disclaimer, the term of this patent is extended or adjusted under 35 U.S.C. 154(b) by 165 days.

(21) Appl. No.: 10/310,356

(22) Filed: Dec. 5, 2002

(65) Prior Publication Data

US 2004/0108052 A1 Jun. 10, 2004

(51) Int. Cl.
*B32B 37/00* (2006.01)

(52) U.S. Cl. ..... 156/250; 156/264; 156/277; 156/521; 156/517; 156/555; 156/556; 156/583.1; 156/351; 156/325; 156/354; 156/355; 156/361; 156/362; 156/363; 156/367; 156/368; 156/378

(58) Field of Classification Search ..... 156/264, 156/277, 521, 517, 555, 556, 583.1, 351, 156/325, 353, 354, 355, 361, 362, 363, 364, 156/367, 368, 378, 265, 302, 512; 270/58.23, 270/58.25; 271/9.01–9.13
See application file for complete search history.

(56) References Cited

U.S. PATENT DOCUMENTS 4,299,637 A 11/1981 Oberdeck et al.
4,643,454 A 2/1987 Ondis
4,659,419 A * 4/1987 Miyake ..... 156/522
4,677,553 A 6/1987 Roberts et al.
4,738,473 A 4/1988 Meloni et al.
4,787,950 A 11/1988 Meloni et al.
4,844,758 A * 7/1989 Hamamura et al. ..... 156/64
4,850,618 A 7/1989 Halladay, Jr.
4,961,808 A * 10/1990 Candore ..... 156/264
5,037,099 A 8/1991 Burtch
5,075,722 A * 12/1991 Adolphson et al. ..... 355/77
5,487,544 A 1/1996 Clapper, Jr.
5,536,008 A 7/1996 Clapper, Jr.
5,609,334 A * 3/1997 Silveira et al. ..... 271/188
5,609,337 A 3/1997 Clapper, Jr.
5,645,485 A 7/1997 Clapper, Jr.
5,673,076 A * 9/1997 Nardone et al. ..... 347/171
5,749,784 A 5/1998 Clapper, Jr.
5,772,510 A 6/1998 Roberts
5,783,024 A * 7/1998 Forkert ..... 156/351
5,810,664 A 9/1998 Clapper, Jr.

(Continued)

FOREIGN PATENT DOCUMENTS

GB 2303613 A * 2/1997

*Primary Examiner*—Philip C. Tucker
*Assistant Examiner*—Kimberly K McClelland
(74) *Attorney, Agent, or Firm*—Russell D. Culbertson; The Culbertson Group, P.C.

(57) ABSTRACT

A covering apparatus (10) includes a cutter (12), an applicator (14) and a continuous length of removable cover material (16). The cutter (12) is adapted to cut off a discrete section (50) of cover material, and the applicator (14) applies the discrete section (50) to a printed media/ticket substrate (52). The covering apparatus (10) may be mounted adjacent to a printer (108) and creates a complete, covered ticket in response to a ticket substrate (52) being ejected from the printer (108) into the covering apparatus.

13 Claims, 16 Drawing Sheets

U.S. PATENT DOCUMENTS 5,824,178 A * 10/1998 Shingu et al. ..... 156/265
5,928,082 A 7/1999 Clapper, Jr.
5,941,771 A 8/1999 Haste, III
5,980,385 A 11/1999 Clapper, Jr.
6,056,289 A 5/2000 Clapper, Jr.
6,283,188 B1 * 9/2001 Maynard et al. ..... 156/521
6,315,020 B1 * 11/2001 Seki ..... 156/351
6,409,872 B1 * 6/2002 Campion et al. ..... 156/264
6,427,744 B2 * 8/2002 Seki et al. ..... 156/353
6,736,179 B2 * 5/2004 Ito et al. ..... 156/351

* cited by examiner

APPARATUS FOR APPLYING A REMOVABLE COVER TO A TICKET SUBSTRATE

TECHNICAL FIELD OF THE INVENTION

The present invention relates to an apparatus and method for applying a removable cover to a ticket substrate, particularly a gaming ticket. The invention also includes a program product for controlling the operation of the ticket covering apparatus.

BACKGROUND OF THE INVENTION

Printed tickets are used in may different types of games of chance. These game tickets include a ticket substrate (also referred to herein as a "gaming ticket substrate") made of paper stock or other suitable media. Various graphic elements and indicia, especially indicia representing game outcomes, are commonly printed on one side of the ticket substrate. Encoded information may also be printed on one or both sides of the ticket substrate in the form of bar codes or other coding devices. Gaming tickets may also include data carrying devices included on the ticket substrate. For example, a magnetic strip may be included on a gaming ticket commonly on a side opposite the printed indicia used in the game. Such data carrying arrangements may be encoded with data such as identifying data for the ticket or for the game outcomes associated with the ticket for example.

Historically, gaming tickets carrying printed indicia that represent one or more outcomes in a game have been preprinted in large lots. These large lots are commonly subdivided into smaller groups which are distributed to vending sites where individual tickets may be purchased by players. The portions of the tickets printed with outcome indicating indicia have commonly been covered or otherwise obscured with some sort of removable material which is to be removed only by the game player/ticket purchaser. Covering the outcome indicating indicia on a gaming ticket prevents an unscrupulous vendor from examining a group of tickets in their control and picking out winning tickets for themselves or their cohorts.

More recently, printed ticket gaming systems have been developed to avoid the expense associated with maintaining security for tickets as they are distributing to vending locations from a central production facility. U.S. Pat. No. 5,941,771 to Haste discloses a gaming system in which printed gaming tickets are printed at a vending location or point of sale. Even though a point of sale printing system may be able to print a ticket with the outcome indicating indicia immediately before the ticket is released to the player or purchaser, it is still desirable, or required by regulation, to obscure the outcome indicating indicia on the ticket before the ticket is released to the player. For one thing, this indicia obscuring requirement helps assure the game player that the game is being administered fairly and that the vendor is not secreting away the winning tickets.

Several different arrangements have been developed for temporarily obscuring the outcome indicating indicia on a game ticket. For example, the game indicia on a ticket may be covered by a layer of obscuring material that may be scratched off to reveal the game indicia. These types of tickets are commonly referred to as "scratch-off" tickets and the games employing such tickets are referred to as "scratch-off" games. Scratch-off tickets may be made by applying the scratch-off material directly to the substrate. This manufacturing method, however, requires specialized and relatively expensive equipment and is thus suited for use only where tickets are created in bulk at a central manufacturing facility and then distributed to vending locations. As shown in U.S. Pat. No. 4,738,473 to Meloni et al., scratch-off material may also be applied to a sheet of clear material and this sheet of material may then be fixed on the ticket to obscure the game indicia on the ticket. In this covering system, an attempt to remove the clear sheet damages the underlying ticket to indicate that the ticket has been tampered with. The arrangement shown in the Meloni patent facilitates the production of scratch-off tickets at vending locations, however, it still requires that the clear sheets be preprinted with the scratch off material using the specialized equipment.

Another arrangement for temporarily obscuring the game indicia printed on a gaming ticket utilizes a cover sheet of opaque material. The opaque cover sheet is secured to the ticket substrate at the time the ticket is manufactured and may be removed by the player after purchasing the ticket. Traditionally, gaming tickets using a removable cover sheet have configured the cover sheet so that several different portions or tabs must be removed to reveal all of the game indicia printed on the ticket. These types of tickets have come to be known as pull tab tickets and the games using such tickets are referred to as pull tab games.

U.S. patent application Ser. No. 10/037,178 filed Oct. 23, 2001, and entitled "Electronic Pull Tab Gaming System," the entire contents of which are incorporated herein by this reference, discloses a gaming system in which large numbers of predetermined game outcomes may be printed on a gaming ticket in the form of various game indicia. The player may then take the gaming ticket to a player station to reveal the predetermined outcomes associated with the indicia printed on the ticket. The player station includes a reader for reading data from the ticket to identify the outcomes associated with the ticket, and also includes a user interface and graphics system that reveals the outcomes to the player in an entertaining fashion. Alternatively, the player may manually look up the indicia in a prize or pay table to learn of the outcomes associated with the ticket, or may have the ticket read by a gaming establishment attendant.

It is desirable, or in some cases required by regulation, to obscure the game indicia on the gaming ticket at the time it is issued to the player in the system described in U.S. patent application Ser. No. 10/037,178. However, because the player station must read data from the ticket substrate in order to identify the predetermined outcomes associated with the ticket, any obscuring material must be capable of being readily removed by the player in such a fashion that it leaves the ticket substrate generally intact. That is, the obscuring material must be capable of being removed without leaving the ticket substrate in a condition that data carried on the substrate cannot be read by a ticket reader associated with the player station.

Scratch-off material is undesirable for use with gaming tickets used in the system described in U.S. patent application Ser. No. 10/037,178 because of the relatively high cost of the material and because the material may leave residue that may ultimately damage the player station card reader or otherwise prevent the reader from reading data from the tickets. Peel-off or tear-off obscuring material must be capable of being removed easily without leaving residues or remnants on the ticket substrate that could interfere with the operation of the player station card readers. What is needed then is an efficient apparatus and method for receiving a ticket printed at the point of sale and applying a nondeforming, easily removable cover material to the ticket substrate prior to issuing the ticket to the player.

SUMMARY OF THE INVENTION

An apparatus according to one embodiment of the present invention includes a cover handling arrangement and an applicator (the applicator also referred to herein as a "cover applicator"). The cover handling arrangement provides a discrete section of the removable cover material, preferably by cutting the section from a continuous length of removable cover material. The applicator, which may comprise an applicator roller, presses the discrete section of cover material against a ticket substrate to allow an adhesive to secure the cover material to the ticket substrate. In the preferred form of the invention, however, the adhesive allows the cover to be readily removed from the ticket substrate without substantially deforming or damaging the substrate. The cover material may include perforations that facilitate removing only a portion of the cover material while leaving other parts of the cover material attached to the ticket substrate. In a further aspect of the invention, the cover applying apparatus is connected to a ticket printer (that is, a gaming ticket printer) and is actuated in response to a ticket substrate being ejected from the ticket printer along a ticket substrate path within the cover applying apparatus.

In one form of the invention, the ticket covering apparatus (that is, the gaming ticket substrate covering apparatus) further includes a cutter adapted to cut a discrete section of cover material from a continuous length of cover material. The cover handling arrangement comprises a conveyor preferably including one or more rollers that receive the discrete section of cover material and convey the section of material to a storage position. From this storage position, the cover handing arrangement conveys the section of cover material to the applicator at the appropriate time for application to the gaming ticket substrate. In addition to the cover conveyor making up the cover handling arrangement, the apparatus according to the invention may include a ticket substrate conveyor positioned between the cover applicator and a gaming ticket substrate receiving platform.

A control system or arrangement is preferably included with the ticket covering apparatus for controlling the operation of the cutter, conveyors, and applicator. The preferred control arrangement includes a controller together with an arrangement of sensors which provide sensor signals to the controller. The controller uses these signals under the control of operational software instructions to produce activating or deactivating signals for motors used to actuate the cutter, conveyors, and applicator. The control system may implement watchdog timers to time the period between operations in the ticket covering device and thereby detect errors in operation.

In one preferred form of the invention, the conveyors included in the apparatus move the cover material along a cover path and move the ticket substrate along a ticket substrate path such that the two paths intersect or cross each other at a crossing point removed from the applicator. This cover and ticket path crossing arrangement enables the ticket covering device to be placed in a very compact space. The preferred cover and ticket path crossing arrangement also allows the ticket covering device to be conveniently aligned and placed in a common enclosure with a ticket substrate printing device.

One preferred form of ticket covering apparatus according to the invention includes a cover material supply conveyor, at least a portion of which is positioned adjacent to the cutter. This cover material supply conveyor operates to advance an end of the continuous length of cover material to a cutting position in which the cutter may sever the desired discrete piece of cover material from the continuous length of material. The operation of this cover material supply conveyor is also preferably controlled through the control arrangement.

These and other advantages and features of the invention will be apparent from the following description of the preferred embodiments considered along with the accompanying drawings.

DESCRIPTION OF PREFERRED EMBODIMENTS

Figure 1:
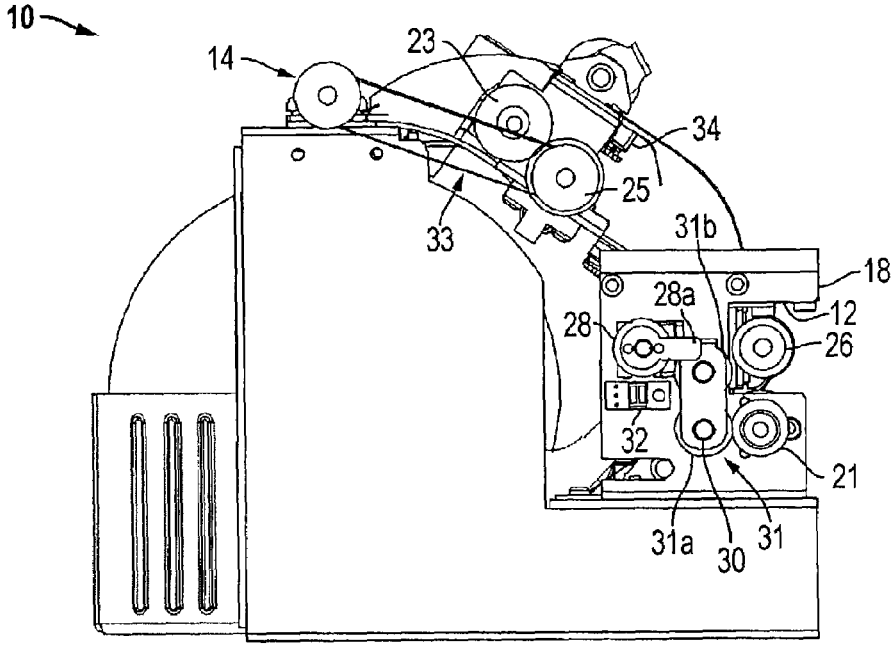
FIG. 1 is a right side view of an apparatus embodying one form of the invention for applying a cover to a ticket substrate.
Figure 2:
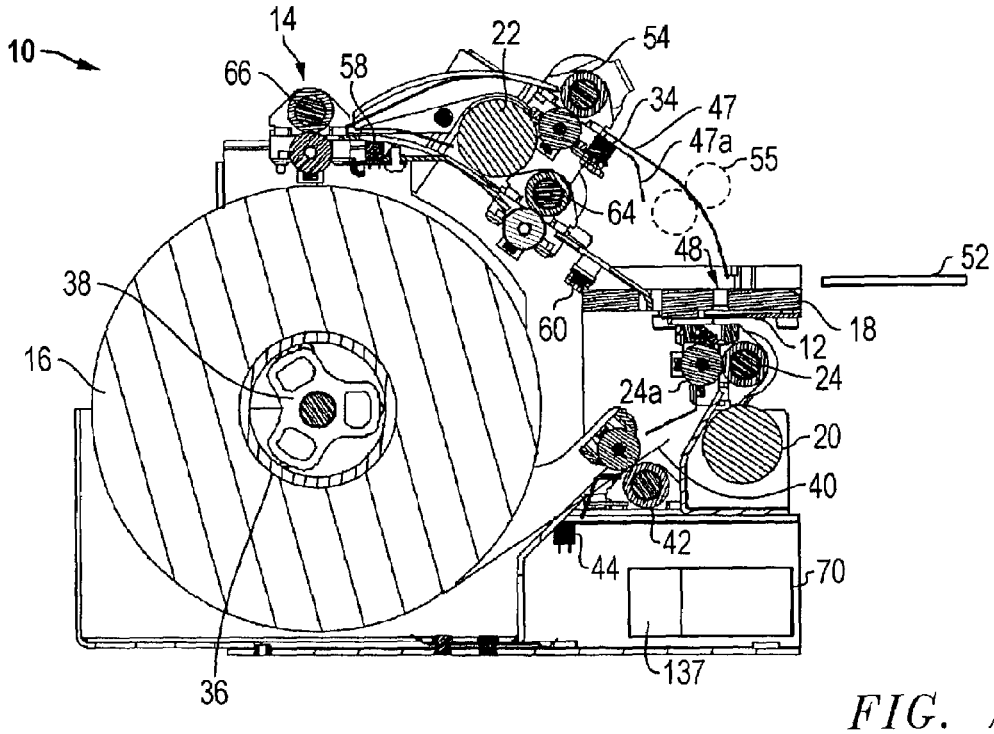
FIG. 2 is a right side section view of the apparatus shown in FIG. 1.

Referring to FIGS. 1 and 2, a preferred ticket covering apparatus or cover mechanism 10 for applying a removable cover to a ticket substrate includes a cutter 12 and an applicator 14. Cutter 12 cuts a discrete section of cover material from a preferably continuous length of cover material 16 (shown only in FIG. 2) stored within covering apparatus 10. Applicator 14 applies or attaches this discrete section of cover material to a ticket substrate to cover at least a portion of one side of the ticket substrate. The ticket substrate and discrete piece of cover material will be described in detail below with particular reference to FIGS. 6A and 6B. However, FIG. 2 shows generally the position from which the ticket substrate 52 is inserted into apparatus 10.

By "continuous length" of cover material, it is meant that cover material 16 stored in apparatus 10 comprises a length of material from which two or more, and preferably many, separate discrete sections of cover material may be cut or otherwise separated. The term "continuous" does not imply that the stored cover material 16 is entirely uniform along its length. In particular, the stored continuous length of cover material 16 may include perforation lines at various positions along its length, although some forms of the invention may not utilize such perforation lines in the cover material.

As shown particularly in FIG. 2, ticket covering apparatus 10 also includes a ticket receiving opening defined on a lower side by ticket receiving platform 18. Ticket receiving platform 18 helps define a first end of a ticket substrate path through apparatus 10 and provides a support surface for a gaming ticket substrate 52 inserted into the ticket covering apparatus.

Ticket covering apparatus 10 also includes a first or lower motor 20 and a second or upper motor 22 shown in FIG. 2. Lower motor 20 drives a cover material supply conveyor which in this form of the invention includes a middle cover roller 24 and a lower cover roller 42. Middle cover roller 24 is driven through a middle cover roller gear 26 shown in FIG. 1 connected at a first end of the middle cover roller. Lower cover roller 42 is connected to be driven concurrently with middle cover roller through a pulley drive arrangement shown generally at reference numeral 27 in FIG. 3, and located on an opposite side of apparatus 10 from the side on which gear 26 is mounted.

Both the cutter 12 and the cover material supply conveyor (made up of rollers 24 and 42 in the illustrated apparatus 10) are driven by lower motor 20 through a lower motor gear 21 and a pivoting drive gear arrangement 31 shown in FIG. 1. This pivoting drive gear arrangement 31 is made up of gear 31*a* and gear 31*b*. When motor 20 is activated to drive lower motor gear 21 in one direction of rotation, the lower motor gear drives gear 31*a* and causes the pivoting drive gear arrangement 31 to pivot about pivot axis 30 to the right in FIG. 1. This brings gear 31*b* in contact with middle cover roller gear 26 to drive middle cover roller 24. When middle cover motor 20 reverses direction to drive lower motor gear 21 in the opposite direction of rotation, this opposite rotation causes pivoting drive gear arrangement 31 to pivot to the left in FIG. 1 to bring gear 31*b* in contact with a cutter drive gear 28 to drive cutter mechanism 12. In this drive arrangement it will be appreciated that cutter 12 and the cover material supply conveyor arrangement cannot be driven or actuated at the same time. Thus, the drive arrangement not only makes efficient use of motor 20, but also ensures that the continuous length of cover material 16 is not in motion during a cutting operation.

Referring still to FIG. 1, a cutter sensor 32 is mounted adjacent to cutter drive gear 28. Cutter sensor 32 cooperates with an extension 28*a* to provide a control signal relating to the operation of cutter 12. Extension 28*a* is connected to rotate with cutter drive gear 28 at an angular orientation so that the extension passes cutter sensor 32 at the end of the cutter operating cycle. Cutter sensor 32 is adapted to detect the presence of the extension as it passes the sensor location at the end of a completed cutting cycle and thus, provides a signal indicating that the cutter 12 has performed the desired cutting function.

Further details of the control and sensor arrangement for the preferred ticket covering apparatus 10 shown in FIGS. 1 through 3 will be described below with reference to FIGS. 13 and 14. However, it should be noted here that the control arrangement includes a control unit including a controller 70 and associated circuitry shown at 137 in FIG. 2. Each of the sensors included in the device described herein may comprise any type of sensor for detecting the presence or absence of an object at a particular point. For example, a sensor used in apparatus 10, may comprise an electrical, photoelectric, laser, optical, or mechanical sensor device. The preferred sensor device produces one output signal state when an object to be detected is present next to the sensor, and an opposite signal state when the object to be detected is not present.

Each roller for conveying either the cover material or a ticket substrate in apparatus 10, such as roller 24 for example, is associated with an opposing surface against which the roller is able to grip the cover and/or ticket material. In ticket covering apparatus 10, the opposing surface comprises a companion roller. The cover material and/or ticket substrate is gripped by, and passes between, the counter rotating pair of rollers. In each roller pair, one of the rollers may include a series of ridges (not shown) or other gripping arrangement which press the cover material and/or ticket substrate against the opposite roller surface. These ridges may be used particularly on the roller located facing the side of the cover material that includes adhesive as will be discussed further below. The ridges minimize the contact with the adhesive and help prevent the inadvertent crumpling of cover material which could result in a jam in the apparatus. Additionally, it will be appreciated that one roller in each companion pair is driven directly either by a gear or a pulley while the other roller in the pair may not be driven directly. For example, middle cover roller 24 is driven directly through gear 26 while its companion roller 24*a* is driven only by contact with the middle cover roller and/or cover material passing there between. Also, although the form of the invention shown particularly in FIGS. 1 through 3 uses rollers, other conveyance devices such as conveyor belts and other devices may alternatively be used to drive cover material and gaming ticket substrates according to the invention.

With reference to FIG. 2, upper motor 22 drives both applicator 14 and a cover handling arrangement made up of upper cover roller 54 and, in some forms of the ticket covering apparatus 10, short cover roller 55 shown in dashed lines. In the preferred drive arrangement, upper motor 22 directly drives upper motor gear 23 shown in FIG. 1. Upper motor gear 23 drives gear 25 connected to ticket roller 64 which makes up a ticket substrate conveyor as will be discussed more fully below. A pulley and belt arrangement 33 connects ticket roller 64 to an exit roller 66 which forms the applicator 14 in the preferred form of the invention. Thus, the ticket roller 64 and the exit roller 66/applicator 14 operate in unison when upper motor 22 is activated. Upper cover roller 54 and short cover roller 55 where present may also be driven by motor 22 as will be described further below.

FIG. 2 shows the continuous length of cover material 16 as a roll of cover material wound on spool 36 attached to freely rotatable support 38. A leading end 40 of the cover material 16 is shown in FIG. 2 at a point just past lower cover roller 42. Roller 42 defines generally the start of a cover path through the apparatus 10 as will be described more fully hereafter. A paper or cover out sensor 44 is located near lower cover roller 42. The function of sensor 44 will be described below with reference to control arrangement for apparatus 10. Alternate forms of the invention may include an additional sensor (not shown) to sense essentially the diameter of the roll of cover material 16 wound on spool 36. This additional sensor may provide a signal once the diameter of cover material 16 on spool 36 reaches a certain point. The signal from this additional sensor may be used to alert an operator that the cover material supply is getting low in apparatus 10.

Middle cover roller 24 receives cover material 16 and guides it further along the cover path through apparatus 10 through an opening 48 in cutter 12. Past cutter 12 the cover material is advanced further along the cover path with the cover handling arrangement made up of upper cover roller 54 and perhaps short cover roller 55. A cover sensor 34 is positioned in the cover path between roller 54 and short cover roller 55. This cover sensor 34 is used to provide signals for use in controlling the operation of lower motor 20 to cut a discrete section of cover material from the continuous length of cover material 16. Once the section of cover material is severed from the continuous length of material, the cover handling arrangement made up of roller 54 and perhaps roller 55 advances the severed section of cover material to a storage position. The operation of sensor 34 and control of lower motor 20, as well as the operation of the cover handling arrangement, will be discussed more fully below with reference to FIGS. 13, 14, and 16 through 20.

The gaming ticket substrate path through apparatus 10 extends from ticket receiving platform 18, past a ticket sensor 60 and ticket roller 64, to an exit sensor, and ultimately to applicator roller 66. The gaming ticket substrate 52 enters the apparatus generally from the position shown in FIG. 2. It will be appreciated from FIG. 2 that apparatus 10 relies upon some additional element for introducing the gaming ticket substrate 52 into the apparatus. As will be discussed below particularly with reference to FIGS. 11 and 12, a preferred embodiment of the invention includes a ticket printer which ejects a printed gaming ticket substrate into apparatus 10 along the initial part of the ticket substrate path. The operation of apparatus 10 to convey the ticket substrate further along the ticket substrate path to applicator 14 will be described below with reference to FIGS. 13 and 19 through 21.

Figure 3:
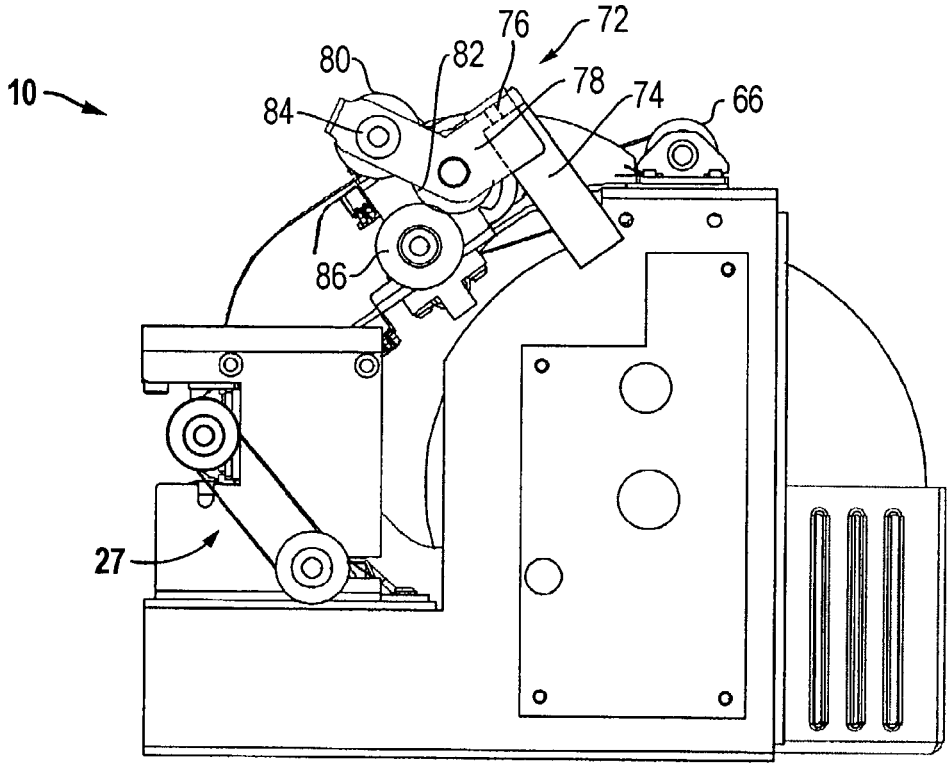
FIG. 3 is a left side view of the apparatus shown in FIG. 1.

Although cover apparatus 10 shown in FIGS. 1 through 3 operates efficiently to bring a section of cover material together with a gaming ticket substrate 52, the apparatus requires an additional element for causing the cover material to adhere to the gaming ticket substrate. In one preferred form of the invention, a low tack or other suitable adhesive material is pre-applied on one side of the bulk cover 16 shown in FIG. 2. As the cover material and ticket substrate are pressed together at applicator roller 66, the adhesive material causes the cover to adhere to the face of the ticket substrate to be covered. The preferred low tack adhesive allows the cover material to be completely removed from the ticket substrate without substantially damaging the ticket substrate. However, other forms of the invention may use a permanent adhesive on the cover material that will not allow portions of the cover material from being removed from the ticket substrate. These forms of the invention may use adhesive only on a small part of the cover material and rely on one or more perforation lines in the cover material for enabling unadhered cover material to be separated from the ticket substrate. It will be appreciated that other arrangements may be used for securing the cover material to the gaming ticket substrate within the scope of the invention including, heat sealing and crimping for example. Also, where adhesive material is used, it may be applied to the gaming ticket substrate 52 rather than the cover material 16.

As mentioned above with reference to FIG. 2, roller 54, applicator roller 66, and ticket roller 64 are preferably all driven by upper motor 22. However, apparatus 10 may be operated in such a way that it is not necessary or undesirable to drive cover roller 54 at the same time as ticket roller 64. Thus, ticket covering apparatus 10 includes an arrangement shown generally at reference numeral 72 in FIG. 3 for selectively disengaging cover roller 54. Cover roller disengagement mechanism 72 includes a solenoid 74 with solenoid plunger 76 in position to contact arm 78. Arm 78 is adapted to pivot about pivot point 84 which lies on the axis of a cover roller gear 80. This cover roller gear 80 rotates with the cover roller 54 shown in FIG. 2 and engages an intermediate gear 82. When arm 78 is in the position shown in FIG. 3, intermediate gear 82 engages a gear 86 fixed on an opposite end of ticket roller 64 from the gear 25 shown in FIG. 1. However, when solenoid plunger 76 is extended, it lifts arm 78 upwardly about pivot 84 so that gear 86 does not engage intermediate gear 82. This removes the driving force to drive cover roller 54. Thus, when it is desired to drive ticket roller 64 in FIG. 2 without driving cover roller 54, solenoid 74 is activated to extend plunger 76 and raise arm 78 to disengage intermediate gear 82 from gear 86. Operating upper motor 22 will then drive only ticket roller 64 and applicator roller 66 shown in FIG. 2. Arm 78 is preferably spring biased or otherwise biased clockwise about pivot 84 in FIG. 3 to cause the arm to return to the position shown in FIG. 3 after being lifted with plunger 76 regardless of the orientation of apparatus 10.

It will be appreciated from FIG. 2 that apparatus 10 includes a number of different guide surfaces for guiding the cover material and ticket substrate material through the apparatus. For example, FIG. 2 shows an outside guide surface 47 for guiding the cover material between roller 55 and roller 54. FIG. 2 also shows an inside guide surface 47*a* also for guiding the cover material between roller 55 and roller 54. All of the inside guide surfaces such as guide surface 47*a* may include ridges (not shown on the scale of FIG. 2) that extend in the direction of the cover material path. As with the above-described ridges on the rollers in apparatus 10, these guide surface ridges minimize contact between the guide surface 47*a* and the surface of the cover material that faces guide surface 47*a*. This minimized contact to just the tops of the ridges in the guide surface helps prevent sticking between the guide surface 47*a* and any adhesive material that is applied to that face of the cover material, and thus helps prevent jams that could be occasioned by such sticking.

Figure 4:
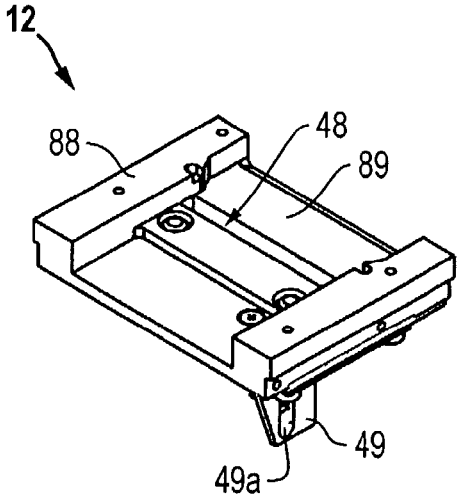
FIG. 4 is a top perspective view of the cutter device used in the apparatus shown in FIG. 1.
Figure 5:
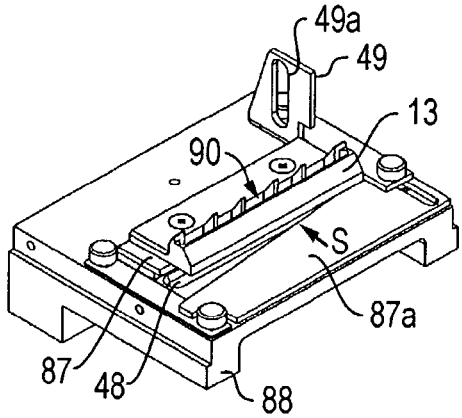
FIG. 5 is a bottom perspective view of the cutter device shown in FIG. 4.

FIG. 4 is a top perspective view of cutter 12 according to one embodiment of the invention. This preferred cutter 12 includes a cutter body 88 which is mounted in apparatus 10 so that upper surface 89 forms part of ticket entry platform 18 shown in FIG. 2. Cutter body 88 includes an opening 48 providing a passage for cover material. Opening 48 allows the cover material to extend generally perpendicularly through cutter body 88. The lower side of cutter 12 is shown in FIG. 5 and includes a stationary or fixed blade 87 mounted on cutter body 88 and a fixed cover guide 13 mounted on the lower side of cutter body 88. Cover guide 13 includes a guide opening 90 that is also adapted to receive the cover material there through similarly to cutter opening 48. Cutter 12 also includes a moving blade 87*a* slidably mounted on cutter body 88 and adapted to be drawn toward fixed blade 87 in the direction of arrow S to provide a cutting action for cover material positioned to traverse cutter body opening 48 and guide opening 90.

In the operation of cutter 12 shown in FIGS. 4 and 5, the continuous length of cover material 16 (not shown in FIGS. 4 and 5) is advanced along the cover material path in apparatus 10 so that the material extends through both guide opening 90 on guide 13, and the cutter body opening 48. Once the cover material is in the desired position for cutting the discrete section of cover material, a slide assembly on which movable blade 87*a* is mounted is moved in the direction S toward the exposed edge of stationary blade 87. The blade edges eventually overlap to provide the desired cutting action to sever the cover material. Once the cover material is severed, the slide assembly carrying movable blade 87*a* is returned back in the opposite direction to direction S to the start position shown in FIG. 5.

Cutter 12 is preferably actuated using a cutter extension 49 mounted on the slide assembly on which movable blade 87*a* is mounted. Cutter extension 49 cooperates with an eccentric pin associated with cutter gear 28 shown in FIG. 1 with the pin extending through slot 49*a* on extension 49. Extension 49 is rigidly connected to the slide assembly so that any movement imparted to the extension along line S in FIG. 5 also causes the slide assembly and thus movable blade 87*a* to slide in that direction. The pin extends from the side of cutter gear 28 opposite to that shown in FIG. 1 and is thus not visible in the drawing. However, it will be appreciated that as cutter gear 28 is driven by gear arrangement 31, the eccentric pin travels in slot 49*a* and causes the extension 49, and thus the slide assembly including movable blade 87*a* to slide in the direction of arrow S in FIG. 5 and then slide back in the direction opposite to that indicated by arrow S. This sliding movement is sufficient to pull blade 87*a* into an overlapping position with fixed blade 87 to sever the cover material, and then return blade 87*a* to the start position shown in FIG. 5.

Figure 6A:
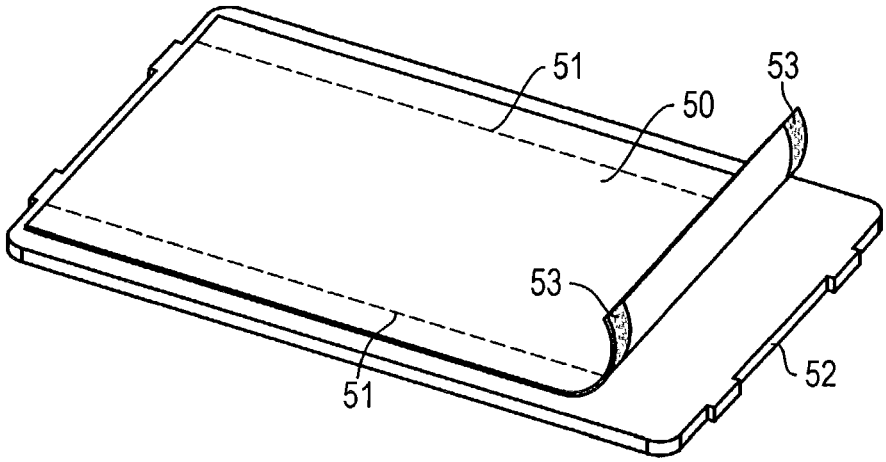
FIG. 6A is a perspective view of a gaming ticket having a cover that may be applied according to the present invention, the cover being shown partially peeled back at one end.

The apparatus 10 illustrated in FIGS. 1 through 3 is adapted to apply an opaque cover to a gaming ticket substrate to produce a covered ticket such as that shown in FIG. 6A. The covered ticket shown in FIG. 6A is made up of ticket substrate 52 having one surface covered with a cover 50 comprising a discrete section of cover material such as that shown at 16 in FIG. 2. One end of cover 50 is peeled back in FIG. 6A to show two adhesive strips 53 deposited on lateral edges of the cover material on the side of the cover facing ticket substrate 52. As previously described, adhesive strips 53 allow the cover material to adhere to substrate 52 so that the cover must be peeled off the substrate. A low tack adhesive may allow the entire cover 50 to be removed in one piece. Alternatively, a stronger adhesive may be applied at lateral strips 53 to securely fasten the lateral edges of the cover 50 and allow only a central portion of the cover to be removed. Perforation lines 51 may be included in cover 50 especially in this latter case to facilitate cleanly removing the central, removable portion of cover 50. Further perforation lines may be used other than those shown for purposes of example at reference number 51 in FIG. 6A. Alternative perforation lines may run transversely or diagonally rather than longitudinally as shown in the drawing.

Although FIG. 6A shows adhesive placed in strips 53 along the edges of cover 50, other forms of the invention may include adhesive covering other portions of cover 50 or the entire surface of cover 50 facing ticket substrate 52. In cases where the entire surface of cover 50 includes the adhesive material, the adhesive will comprise a low tack adhesive that will allow cover 50 to separate readily from ticket substrate 52 without damaging the ticket substrate. Also, where adhesive is placed over the entire surface of the cover 50 that will face ticket substrate 52, all cover material guide surfaces in apparatus 10 shown in FIGS. 1 through 3 and the rollers that contact the adhesive side of cover material 50 preferably include ridges that minimize contact with the adhesive material as the cover material is advanced through apparatus 10. The cover material guide and other surfaces in apparatus 10 with these longitudinal ridges may provide the desired guiding or gripping action for the cover material as the material advances through apparatus 10 without causing the adhesive to stick to the surfaces. Such sticking would at least crumple the cover material and cause a jam in apparatus 10.

Figure 6B:
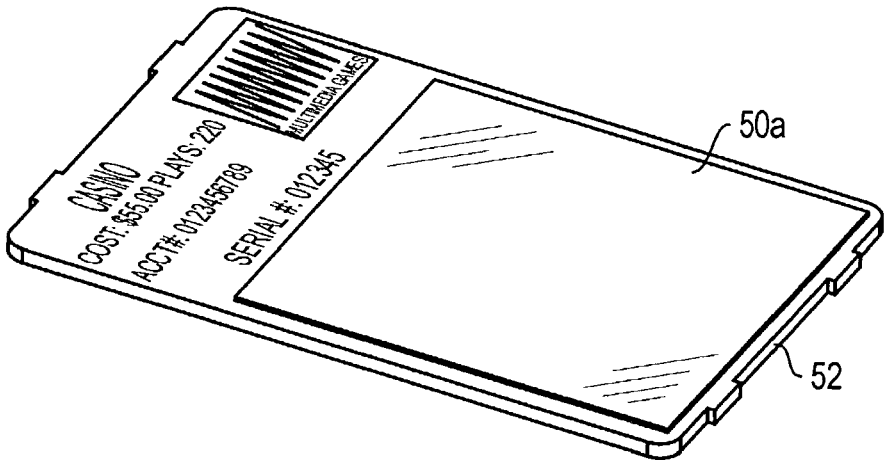
FIG. 6B is a perspective view of a gaming ticket having an alternate cover that may be applied according to the present invention.
Figure 8:
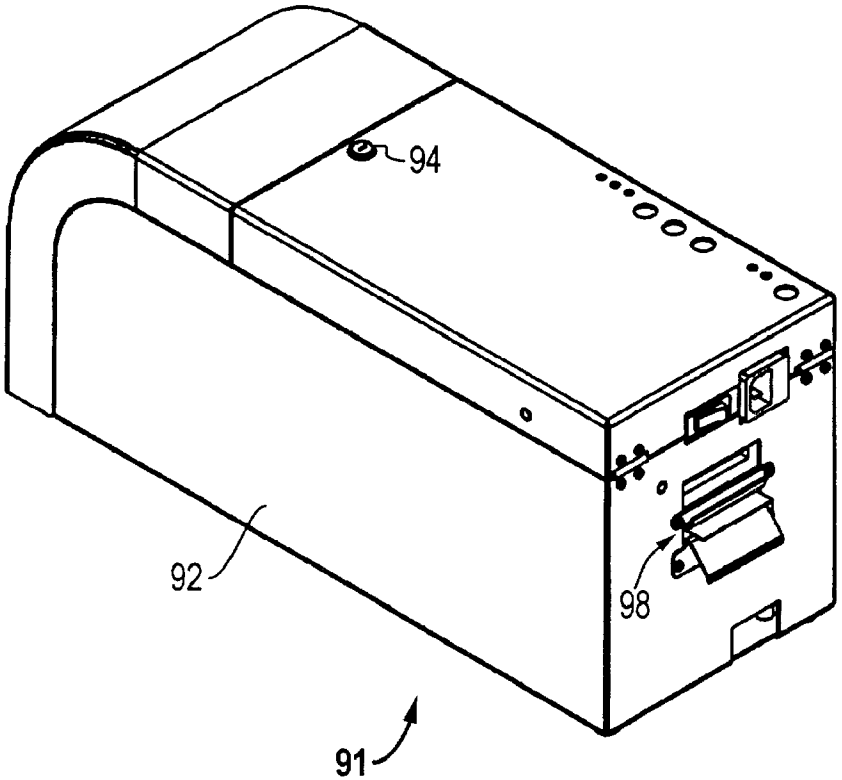
FIG. 8 is a rear perspective view of the enclosure shown in FIG. 7.
Figure 7:
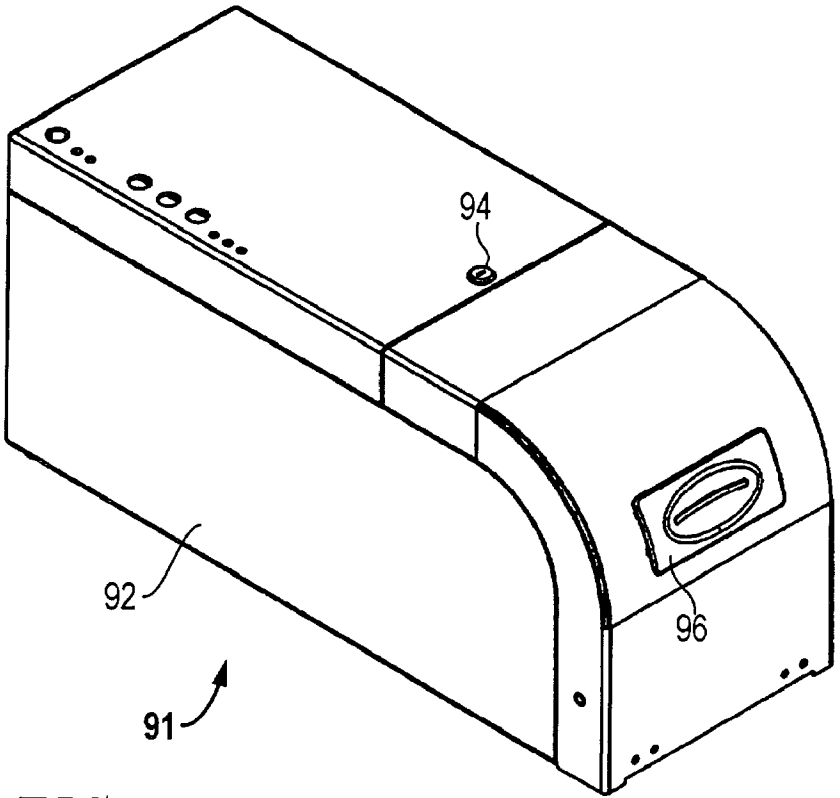
FIG. 7 is a front perspective view of a preferred enclosure for the ticket covering apparatus.

FIG. 6B illustrates a gaming ticket substrate 52 having a surface that is only partially covered with a cover 50*a*. As in the embodiment shown in FIG. 6A, cover 50*a* may be formed from any suitable cover material that obscures game indicia printed on the covered face of gaming ticket substrate 52. Additionally, cover 50*a* may be any shape and any color, and may itself be covered with printed indicia. It will be appreciated that cover 50*a* may be attached to gaming ticket substrate 52 using any suitable adhesive as described above with reference to FIG. 6A and elsewhere. The adhesive may be located on the cover material, and perforation or other tear lines may be positioned so that sections of the cover may be removed to reveal some indicia on the substrate, while leaving other indicia concealed.

The form of covered ticket shown in FIG. 6B includes header information printed or otherwise formed on a leading end of ticket substrate 52 and cover 50*a* covering generally a trailing end of the ticket substrate. Other forms of the invention may position the header information at the trailing end of the ticket substrate and the cover at the leading end. Yet other forms of the invention could place cover 50*a* along one lateral side of ticket substrate 52 and the header information along the opposite lateral side. In cases where only a portion of a side of ticket substrate 52 is covered, the present invention is not limited by which particular portion of ticket substrate is covered by the cover material.

In the preferred form of the invention using low tack adhesive to only temporarily attach the cover 50 or 50*a* to ticket substrate 52, it may be possible to remove the cover and then reattach it after seeing the game indicia printed on the ticket. However, in the forms of the invention using more permanent adhesives, it may be possible to see the game indicia printed on the ticket only after tearing the cover material. In this case there is no easy way to reattach the cover in a fashion that conceals the fact that the ticket has been read. In either case, the preferred covering apparatus according to the present invention attaches the cover material to the ticket substrate so that the cover material may be removed without substantially damaging the ticket. As used in this disclosure and the accompanying claims, the ticket would be substantially damaged if it could not be read by a suitable ticket reading device, such as a mag strip reader or bar code reader.

Figure 10:
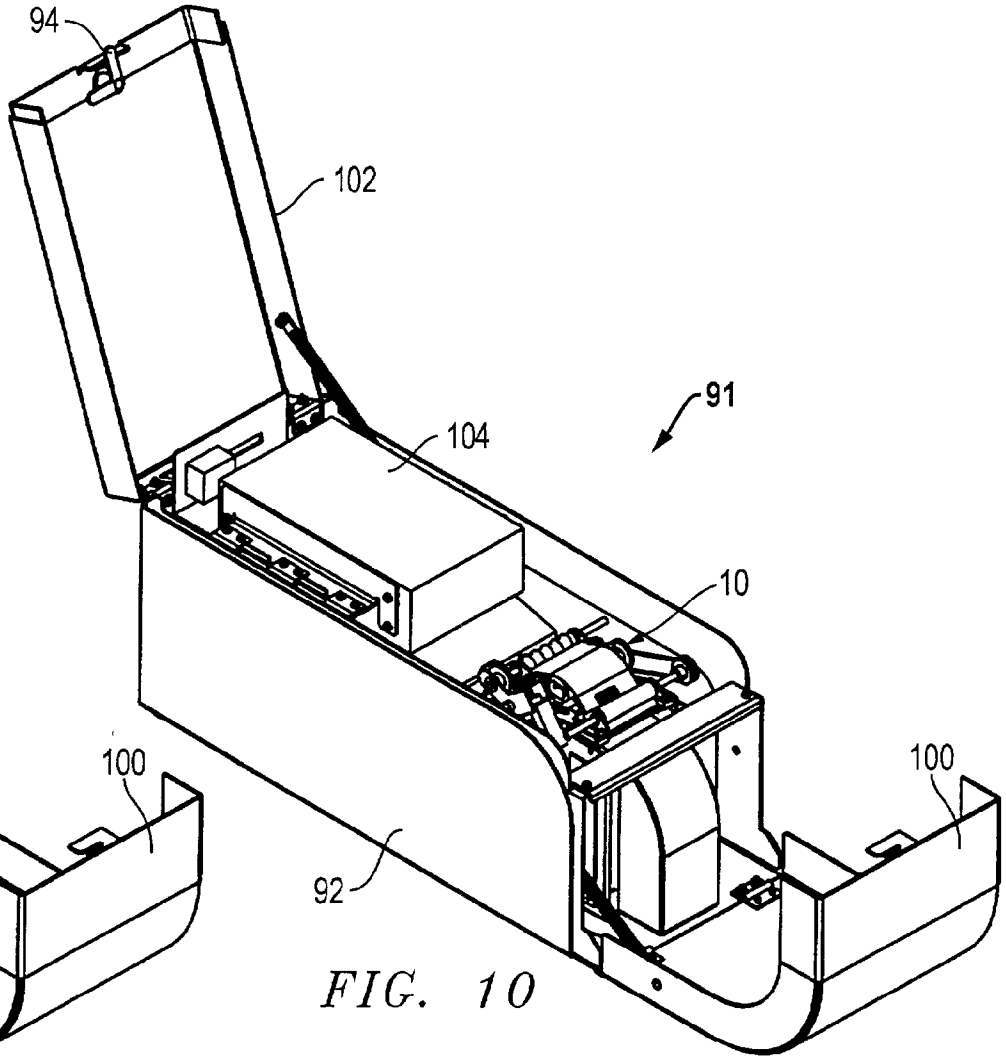
FIG. 10 is a front perspective view of the enclosure shown in FIG. 7 with a front and rear access open.
Figure 9:
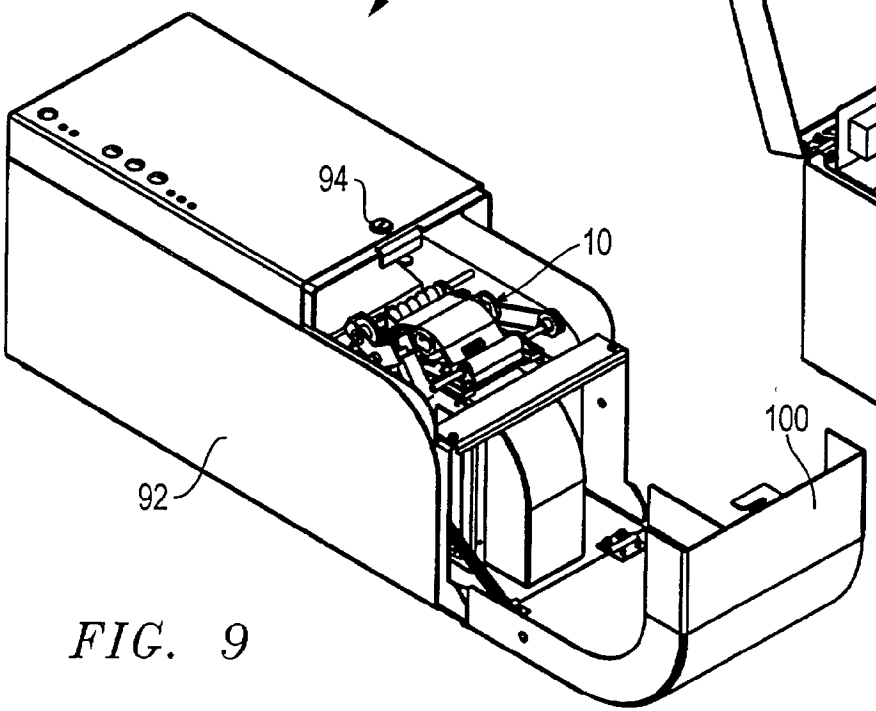
FIG. 9 is a front perspective view of the enclosure shown in FIG. 7 with a front access open.
Figure 11:
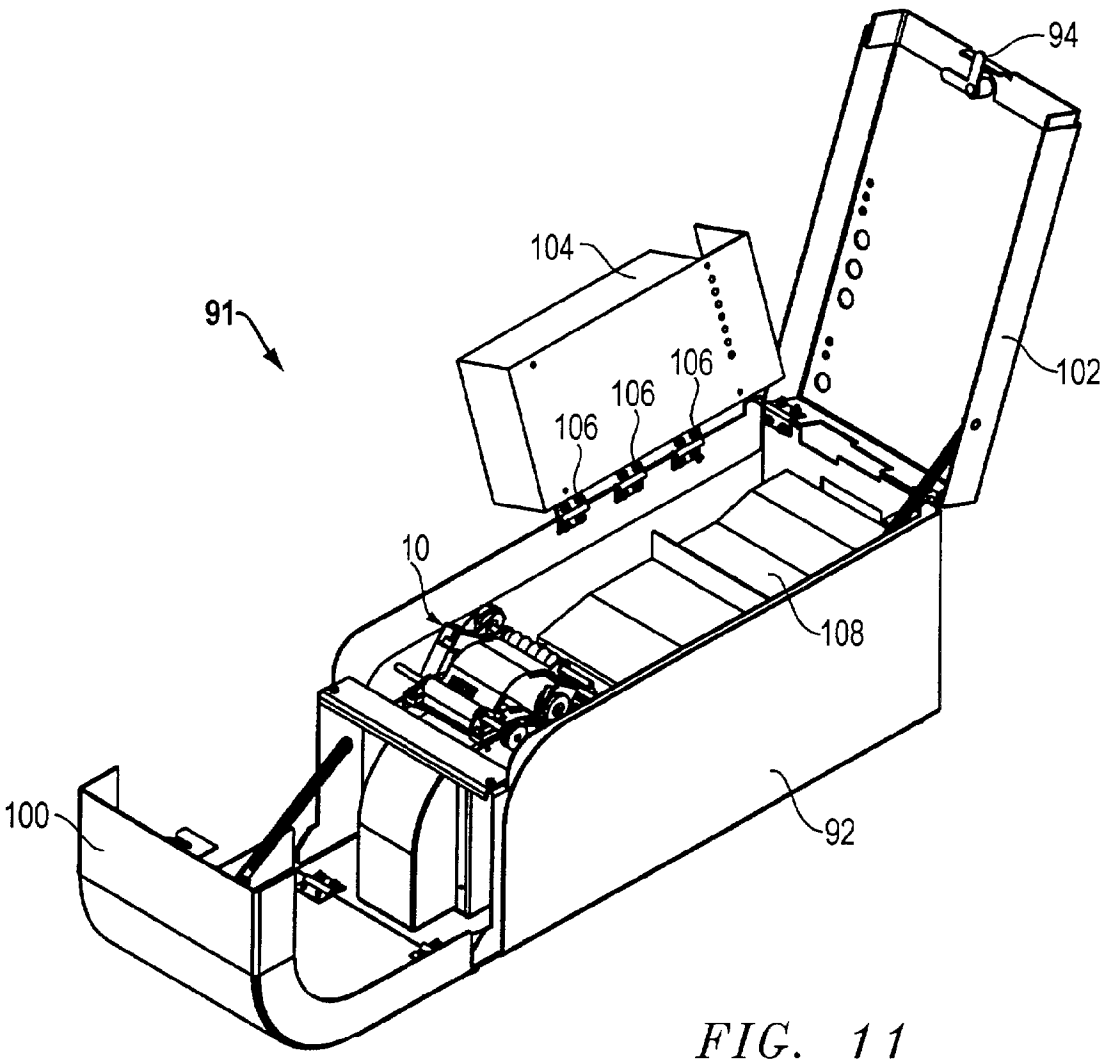
FIG. 11 is a front perspective view of the enclosure shown in FIG. 7 with a front and rear access open and a power supply rotated up and out of the enclosure.

FIGS. 7-12 show a gaming ticket production system 91 that may utilize the covering apparatus 10 according to the invention. System 91 includes an enclosure 92 which may be securely locked with lock 94. Enclosure 92 includes a covered ticket exit 96 shown in FIG. 7 and ticket substrate entrance 98 shown in FIG. 8. FIG. 9 shows sealed enclosure 92 in an unlocked condition with a front access door 100 open. In this condition a ticket covering apparatus 10 as disclosed above with reference to FIGS. 1 through 3 is visible within enclosure 92. FIG. 10 shows enclosure 92 in an unlocked condition with both front access door 100 and rear access door 102 open. The open access door 102 exposes a power supply 104 contained within enclosure 92 for providing the required electrical power to operate ticket covering apparatus 10 and the other devices included within enclosure 92. As shown in FIG. 11, power supply 104 may be mounted in enclosure 92 on hinges 106. This allows power supply 104 to be conveniently swung out of the way to gain access to a ticket printer 108 which is also mounted in enclosure 92. Ticket printer 108 preferably comprises a device shown contained within a printer housing for printing visible or human readable indicia on one surface of a gaming ticket substrate. It is this surface that is partially or fully covered with cover material using apparatus 10. Ticket printer 108 may also include an arrangement for encoding data on the ticket substrate in the form of a bar code or data stored on a magnetic stripe included on the ticket substrate.

Figure 12:
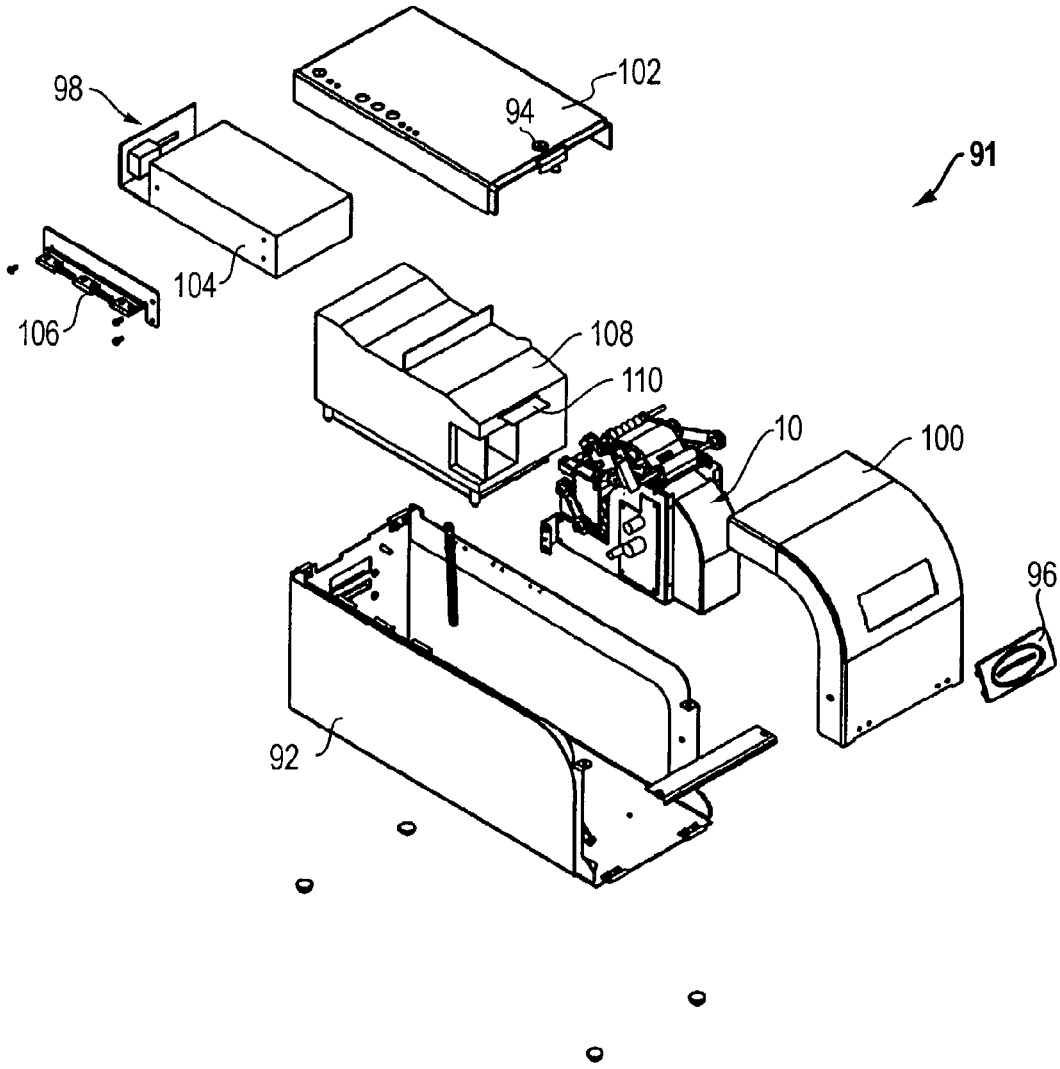
FIG. 12 is an exploded view of the assemblies included in the enclosure shown in FIG. 7.

Ticket printer 108 is situated within enclosure 92 so that a printed ticket ejection opening 110 shown in the exploded view of FIG. 12, align with ticket receiving platform 18 (FIG. 2) of covering apparatus 10. Thus, ticket printer 108 ejects a printed ticket directly into covering apparatus 10. The gaming ticket may be printed with printer 108 and, upon ejection from the printer, immediately covered by apparatus 10 while the ticket is still securely held in enclosure 92, inaccessible to players and the game operator alike. The newly printed, and covered gaming ticket is ejected from system 91 through ticket exit opening 96.

The system 91 shown in FIG. 12 relies on a supply of unprinted or partially unprinted gaming ticket substrates outside of enclosure 92. It will be appreciated that enclosure 92 may be modified within the scope of the present invention to include an area for containing a supply of unprinted or partially printed gaming ticket substrates.

The operation of ticket covering apparatus 10 and methods embodying the principles of the invention may be described with reference to the diagrams shown in FIGS. 13 and 14, and the operation sequence diagrams shown in FIGS. 15 through 21. Referring first to FIG. 14, a preferred control arrangement for apparatus 10 shown in FIGS. 1 through 3 includes a control portion including controller or microcontroller 70 together with several device control circuits shown in dashed box 137. The preferred control arrangement further includes the sensor arrangement described above with reference to FIG. 2, paper out sensor 44, cutter sensor 32, cover sensor 34, ticket sensor 60, and exit sensor 58.

Controller 70 comprises a suitable controller or processing device capable of receiving the system inputs from the sensor arrangement and providing the desired control signals to the device controller circuits, a solenoid relay 142, and two motor control circuits 138 and 140. Controller 70 may comprise a general purpose processor adapted to operate under the control of operational program code to produce the desired control signals in response to the sensor and other input signals. Alternatively, controller may comprise a hardwired logic circuit or a gate array configured to emulate a hardwired circuit. In any case, controller 70 provides a logical control signal to selectively turn solenoid relay 142 on or off and thereby selectively energize solenoid 74. Both motor control circuits may comprise H-Bridge circuits that are adapted to selectively provide power to the respective motor in response to one or more logical signals from controller 70. A single logical signal applied to control circuit 140 causes the circuit to selectively apply operating power to upper motor 22. Only a single logical signal is needed for circuit 140 because upper motor 22 will either be on or off. Two logical input signals are required for control circuit 138 to provide on/off control and direction control for lower motor 20.

As discussed above with particular reference to FIG. 2, sensors 32, 34, 44, 58, and 60 may comprise any suitable sensors capable of detecting the presence of an object. Regardless of the particular technology used to implement the respective sensor, each sensor preferably provides a logical level signal to controller. It will be appreciated that the invention is by no means limited to the particular sensor arrangement shown in FIG. 2 and FIG. 14. More or fewer sensors may be used to provide the desired control. For example, one or more sensors may be eliminated by using timers to time the operational states of the device. Control signals could also be developed from the rotation of the motors to eliminate sensors. Also, additional sensors could be used to provide further control over the system.

Various operational states of ticket covering apparatus 10 along with some of the software instructions that may be employed by the system may be described with reference to FIG. 13. It will be appreciated that references to the elements in the apparatus will generally be to FIGS. 2 and 14, while the references to operation states will be to FIG. 13.

When ticket covering apparatus 10 is first turned on, operational program code executed by controller 70 places the covering apparatus in an initialization state shown at reference numeral 116. In this initialization state 116, controller 70 may cycle the cutter 12, and perform other initialization steps such as checking the state of sensor 44 to determine if cover material is loaded in apparatus 10. If paper/cover out sensor 44 does not detect cover material 16, the controller goes to a paper out state 118. In this paper out state 118, controller 70 preferably sends a "paper/cover out" signal by suitable means to a system operator to notify the operator that the covering apparatus needs to be reloaded with a continuous length of cover material 16. If the state of sensor 44 indicates that paper/cover material is present in apparatus 10 and no other errors are detected, controller 70 checks the state of cover sensor 34 to determine whether or not a discrete section of cover material has already been stored by the cover handling arrangement. If the signal from cover sensor 34 indicates that a discrete section of cover material has not been stored, the controller 70 goes to a load cover state 120. If sensor 34 indicates that a cover is already stored, controller 70 goes to an idle state 126 to wait for another input.

In load cover state 120, upper motor 22 may remain off while lower motor 20 is driven (through control circuit 138 in FIG. 14) in a first direction to drive lower cover roller 42 and middle cover roller 24. Driving these rollers causes the rollers to advance the leading end 40 of cover material 16 along the cover path through apparatus 10. Rollers 42 and 24 continue to be driven until the leading end 40 of the cover material 16 passes cover sensor 34. The signal from cover sensor 34 indicating that the cover material is present at that point triggers the end of the load cover state 120 and causes controller 70 to proceed to a cut cover state 122.

Figure 14:
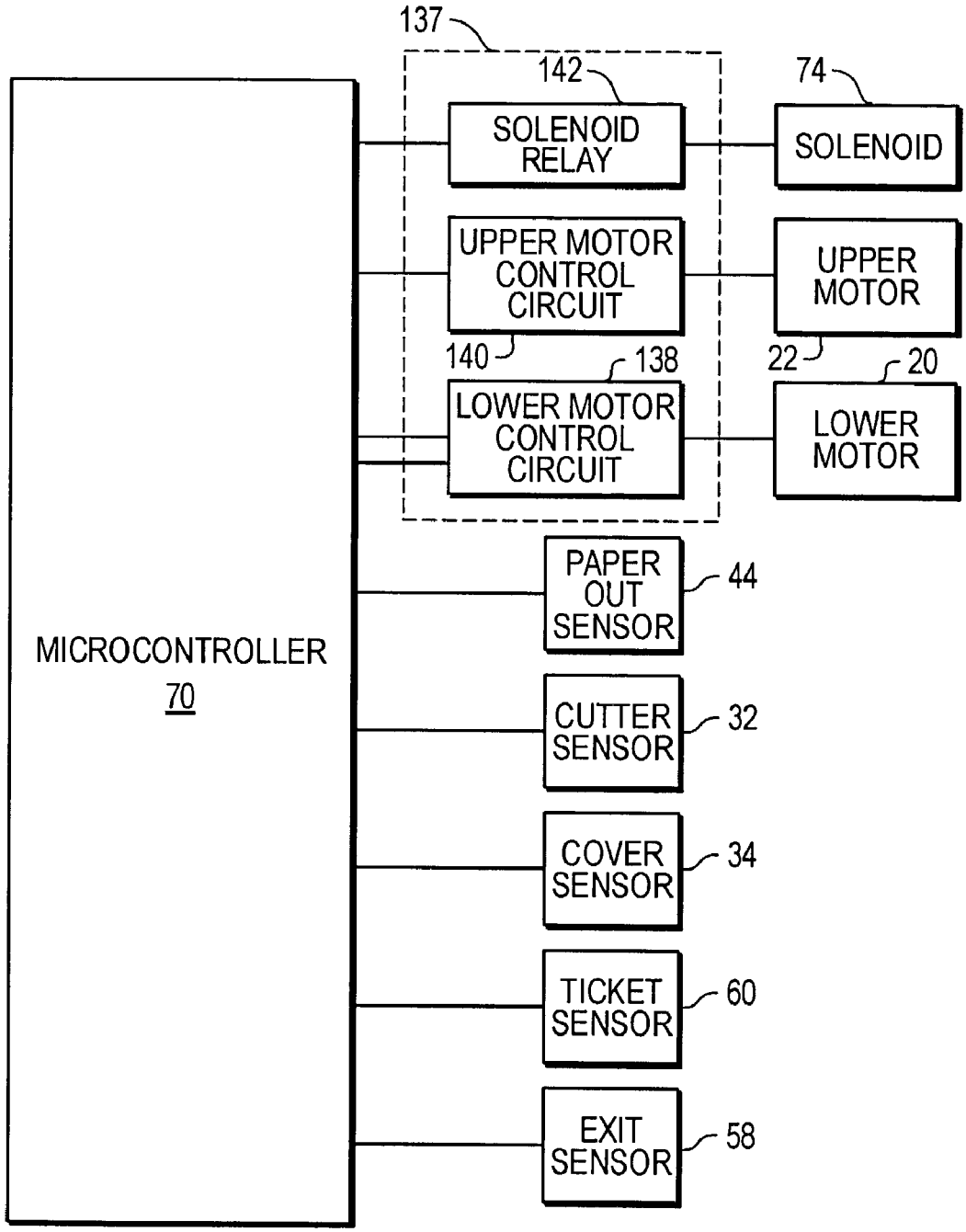
FIG. 14 is a diagram illustrating one preferred form of control system for a ticket covering device according to the present invention.

In the cut cover state 122 cutter instructions executed by controller 70 cause the controller to provide a cutter control signal through control circuit 138 in FIG. 14 to reverse lower motor 20. As discussed above with reference to FIG. 1, reversing motor 20 causes pivot gear arrangement 31 to disengage roller 24 and engage cutter drive gear 28. This operation of pivot gear arrangement 31 simultaneously stops rollers 24 and 42 and causes cutter 12 to start a cutting cycle. Cut cover state 122 continues with motor 20 driving cutter 12 until extension 28*a* reaches cutter sensor 32 to change the state of the signal from the cutter sensor. This change in signal state at cutter sensor 32 indicates that cutter 12 has completed its cutting cycle and that the desired discrete section of cover material (50 in FIG. 6A and 50*a* in FIG. 6B) has been severed from the continuous length of cover material 16 and that the system can thus move on to the store cover state 124.

In the store cover state 124, lower cover motor is turned off and upper cover motor 22 drives upper cover roller 54 (and/or short upper cover roller 55) to advance the discrete section 50 of cover material 16 to the storage position. The system may set the storage position in terms of a period of time for operating cover roller 54 and/or short cover roller 55. Alternatively, another sensor may be used to provide a signal when the discrete section of cover material 50 or 50*a* has reached the desired storage position. In any case, when the desired discrete section of cover material is in the stored position, controller 70 places the system in an idle state 126 to wait for the next input.

From idle state 126, controller 70 causes the system to proceed to a ticket enter state 128 in response to a signal from ticket sensor 60 indicating that a ticket substrate 52 has been inserted along the ticket substrate path through the apparatus and has reached the ticket sensor. In the ticket enter state 128, applicator instructions executed by controller 70 causes the controller to direct an application signal to upper motor 22 to turn the motor on. Simultaneously, controller 70 signals relay 142 to energize solenoid 74. With solenoid 74 energized, upper cover rollers 54 remain stationary while motor 22 drives ticket roller 64 to grab the inserted ticket substrate and advance it further along the ticket substrate path through apparatus 10 toward exit sensor 58 and exit or applicator roller 66.

From ticket enter state 128, controller 70 places the system in a cover ticket state 130 when exit sensor 58 is triggered by the leading end of the ticket substrate advancing along the ticket substrate path. In the ticket cover state, controller 70 executes cover material advancement instructions and provides a cover advancement signal to relay 142 to cause solenoid 74 to be de-energized. De-energizing solenoid 74 places the pivot arm 78 shown in FIG. 3 in position to allow gear 86 to again drive upper cover roller 54. With the ticket roller 64 and upper cover roller 54 both engaged, the rollers advance the ticket substrate and discrete section of cover material, respectively, along their respective paths toward the applicator roller 66 which is also engaged and ready to receive the ticket substrate and cover material. Exit roller 66 presses the discrete section 50 or 50*a* of cover material 16 onto ticket substrate 52 and drives the completed gaming ticket out of the apparatus 10. This cover ticket state 130 continues until the trailing edge of the ticket substrate 52 passes exit sensor 58. The change in state in the signal from exit sensor 58 causes controller 70 to turn off upper cover motor 22 and return to the load cover state 120 described above. The timing of turning off motor 22 can be conformed so that the completed ticket is completely ejected form apparatus 10 or is retaining in the apparatus, still gripped by exit or applicator roller 66.

In normal operation of the apparatus 10, the timing between events or system states may be predicted with some certainty. A preferred form of the invention employs watchdog timers preferably implemented through controller 70 to count (or count down) the time between events in the system. When a predicted time between events time is exceeded, controller 70 operates under the control of error state software instructions to cause the system to go to an error state 132. In this state, the controller preferably produces a signal indicating the error and communicates the signal to a system operator. Controller 70 otherwise turns both motors off and simply maintains the system condition until the apparatus can be serviced by the system operator.

Figure 13:
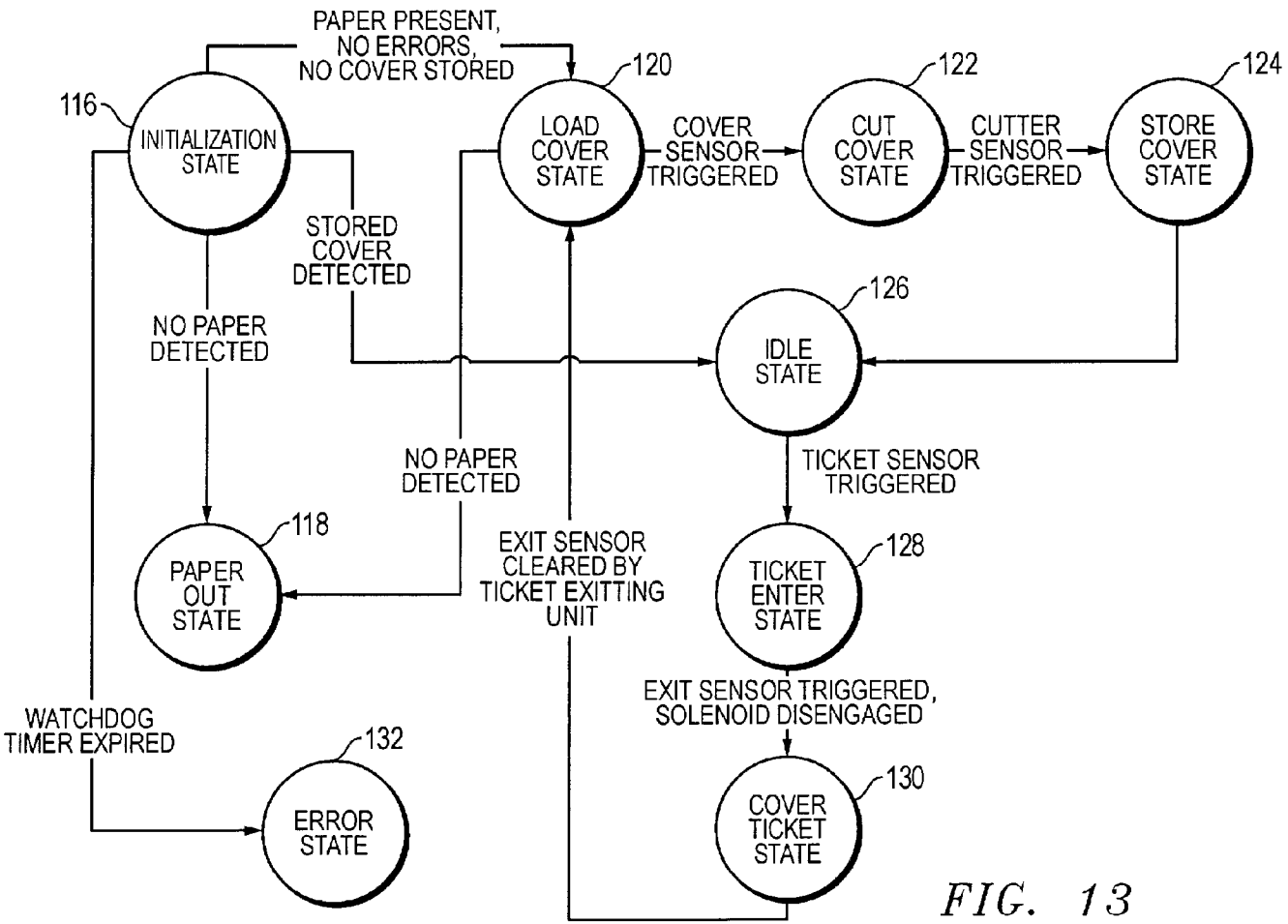
FIG. 13 is a state diagram illustrating the various process states of a preferred ticket covering apparatus according to the invention.
Figure 15:
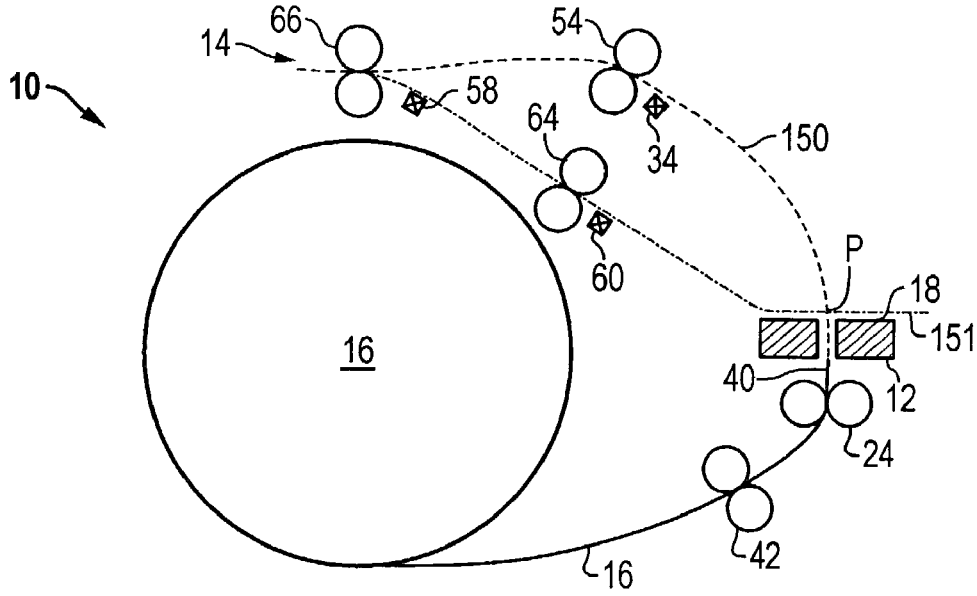
FIG. 15 is a diagrammatic representation of the covering apparatus shown in FIG. 1, the diagrammatic representation showing the state of the apparatus after initialization with no cover loaded.
Figure 16:
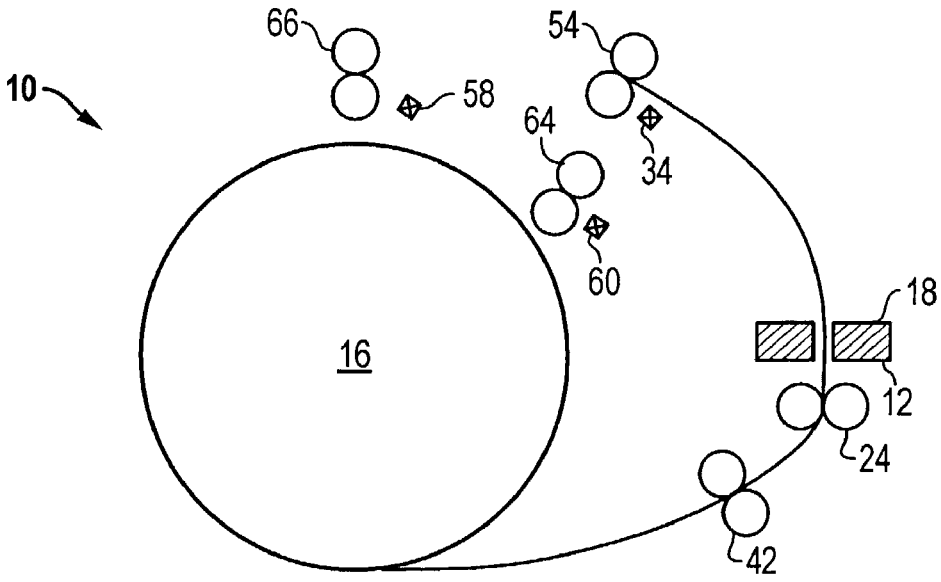
FIG. 16 is a diagrammatic representation similar to FIG. 15, but showing a continuous length of cover material advanced to the point at which a discrete cover section may be severed.
Figure 17:
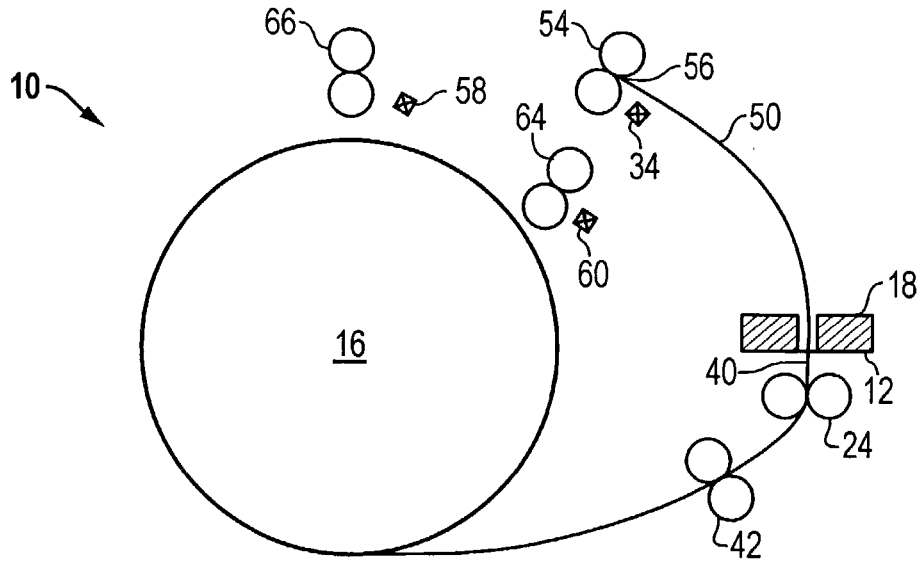
FIG. 17 is a diagrammatic representation similar to FIG. 15, but showing the cover section severed from the continuous length of cover material.
Figure 18:
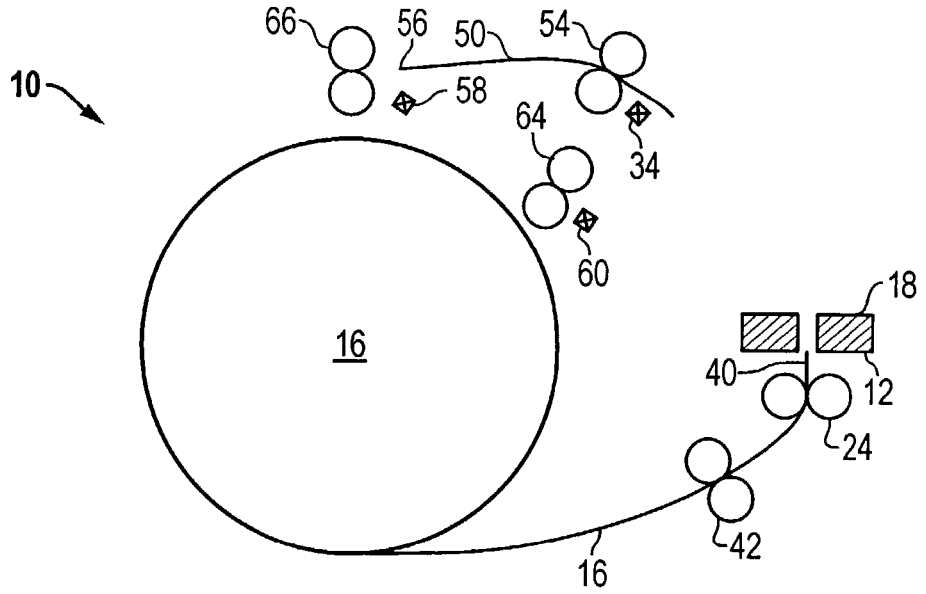
FIG. 18 is a diagrammatic representation similar to FIG. 15, but showing the severed section of cover material advanced to a storage position.

The diagrammatic representations in FIGS. 15 through 21 may be used with reference to FIG. 13 to show the positions of the continuous cover material 16, discrete section of cover material 50, and ticket substrate 52 at various points in the operation of apparatus 10. FIG. 15 illustrates the condition of covering apparatus 10 at the beginning of load cover state 120. No cover is stored and the leading edge 40 of the continuous cover material 16 remains generally at cutter 12. FIG. 15 also shows the cover material path and ticket substrate path through apparatus 10. In particular, cover material path is shown with a dashed line 150 while the ticket substrate path is shown with a dashed and dotted line 151. FIG. 16 shows the condition of apparatus 10 at the end of load cover state 120. In this condition the continuous cover material 16 has been advanced along cover path 150 generally to upper cover roller 54. FIG. 17 illustrates apparatus 10 at the end of cut cover state 122 in which a cover 50, that is, a discrete section of cover material, has been severed from the continuous length of material 16. This cover 50 includes leading end 56 in position to be gripped by upper cover roller 54. The severed material just below cutter 12 forms the new end 40 of continuous material 16. FIG. 18 illustrates the end of store cover state 124 and the idle state 126 in which cover 50 has been moved along cover material path 150 to the storage position.

Figure 19:
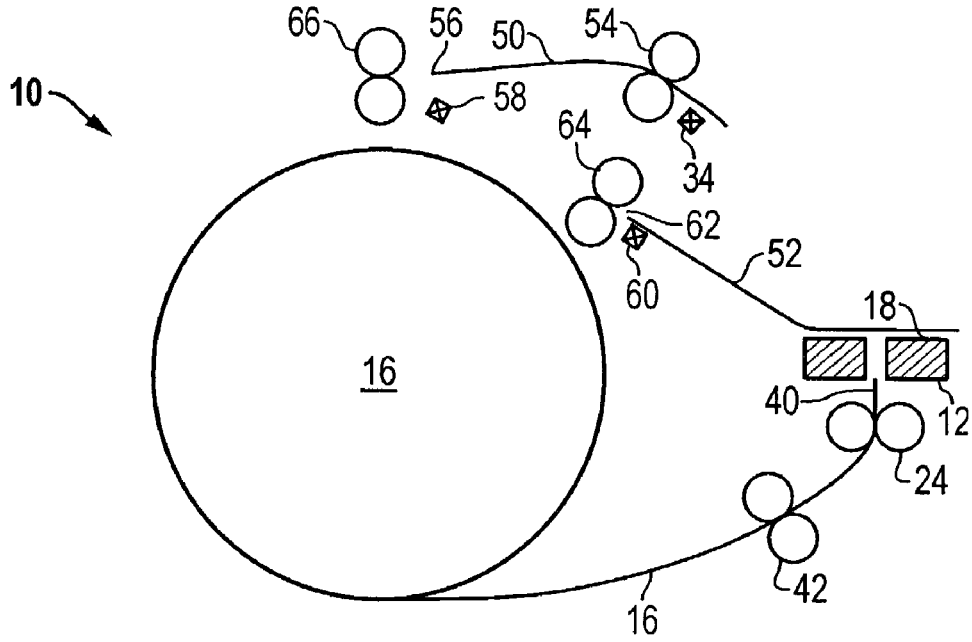
FIG. 19 is a diagrammatic representation similar to FIG. 18, but showing a ticket substrate inserted into the system from a ticket substrate printing device.

FIG. 19 illustrates the start of the ticket enter state 130. In this condition, ticket substrate 52 has been inserted along the start of the ticket substrate path 151 (the path being shown in FIG. 15), with a leading edge 62 of the substrate passing sensor 60 and making contact with ticket roller 64. The detection of the ticket substrate 52 at sensor 60 prompts the ticket enter state 130. In this state, ticket substrate 52 is driven by the ticket rollers 64 further along ticket substrate path 151 toward the exit sensor 58 and applicator roller 66.

Figure 20:
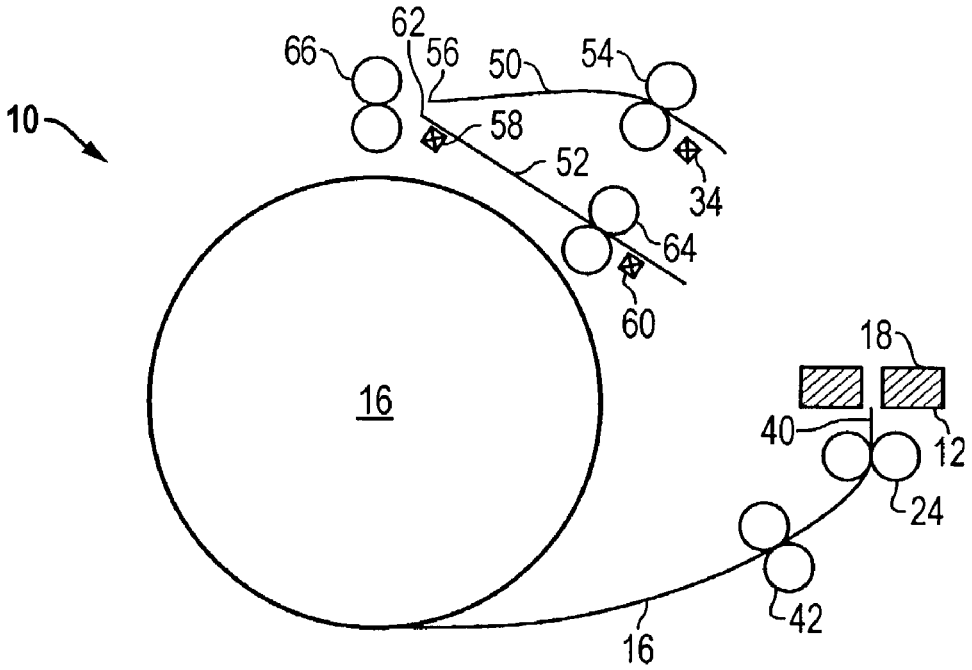
FIG. 20 is a diagrammatic representation similar to FIG. 19, but showing the ticket substrate advanced to an exit sensor.

Controller 70 disengages upper cover rollers 54 and the stored discrete section 50 of the cover material stays in the stored position. Ultimately, the exit sensor 58 is triggered by the leading edge 62 of ticket substrate 52 as shown in FIG. 20 to start cover ticket state 130. In cover ticket state 130, the upper cover roller 54 is re-engaged so that both the stored cover section 50 and the ticket substrate 52 are driven together into and through the exit or applicator rollers 66.

Figure 21:
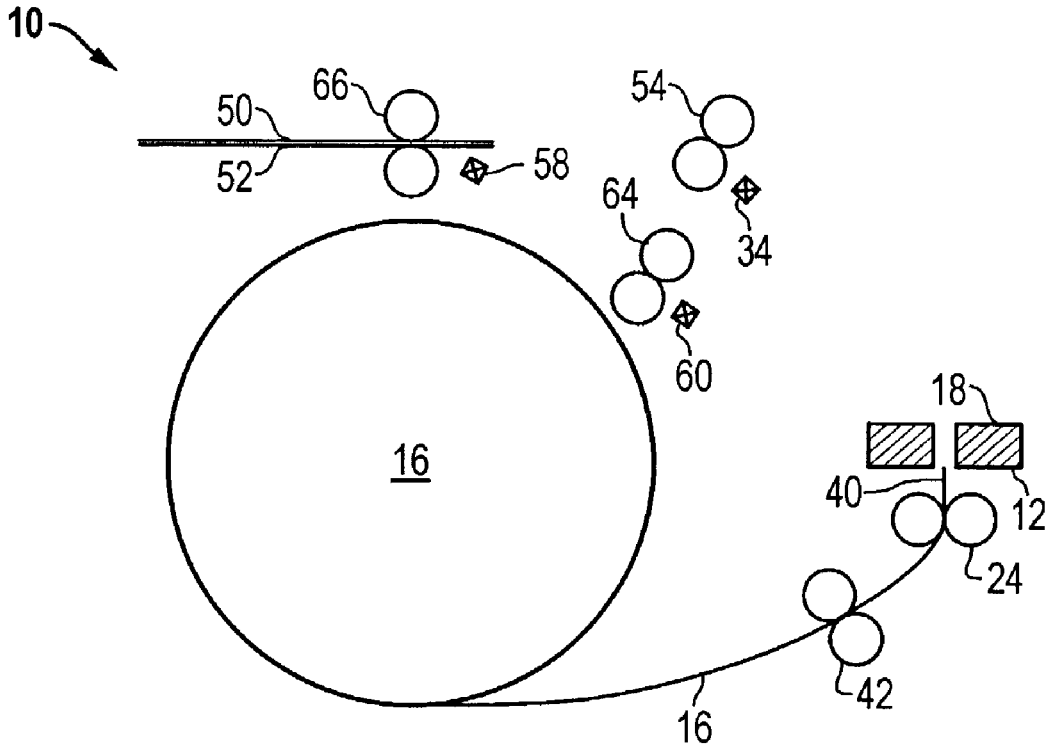
FIG. 21 is a diagrammatic representation similar to FIG. 20, but showing the section of cover material and the ticket substrate being advanced and pressed together by the applicator portion of the covering device.

FIG. 21 illustrates the condition of apparatus 10 at the end of cover ticket state 130. At this point, exit sensor 58 is being cleared by an exiting ticket substrate 52. This will prompt the system to return to the load cover state 120 in which the cover supply rollers 24 and 42 are activated to advance the cover material 16 from the point shown in FIG. 15 to the point shown in FIG. 16.

As shown in FIG. 15, cover path 150 actually crosses or intersects ticket substrate path 151 in the illustrated preferred covering apparatus 10. This intersection occurs at crossing point P removed from the applicator roller 66. The intersecting path arrangement is advantageous because it allows the covering device to align with a printing device as shown in FIGS. 7 through 12. However, the intersecting path system shown for apparatus 10 does require special timing between the introduction of a ticket substrate and the movement of cover 50 to the storage position. In particular, apparatus 10 is unable to accept a ticket substrate unless the apparatus is in the idle state 126 described above. Because the preferred systems employing apparatus 10 include some additional element such as a printer to insert the ticket substrate into the covering apparatus, the invention includes producing a suppression signal from apparatus 10 to the ticket substrate inserting device. This suppression signal may be generated through controller 70 in apparatus 10 under the control of program instructions as described above and prompts the ticket substrate inserting device such as printer 108 in FIGS. 11 and 12 to delay issuing a ticket until apparatus 10 is in the idle state 126 in FIG. 13 and thus in position to receive and cover the ticket substrate.

FIGS. 22 through 25 illustrate an alternate apparatus 10' embodying the principles of the present invention. Apparatus 10' includes a somewhat different arrangement of sensors and a somewhat different roller and drive arrangement. Apparatus 10' also includes cover path and ticket path access features that will be described below with reference to FIG. 25.

Figure 23:
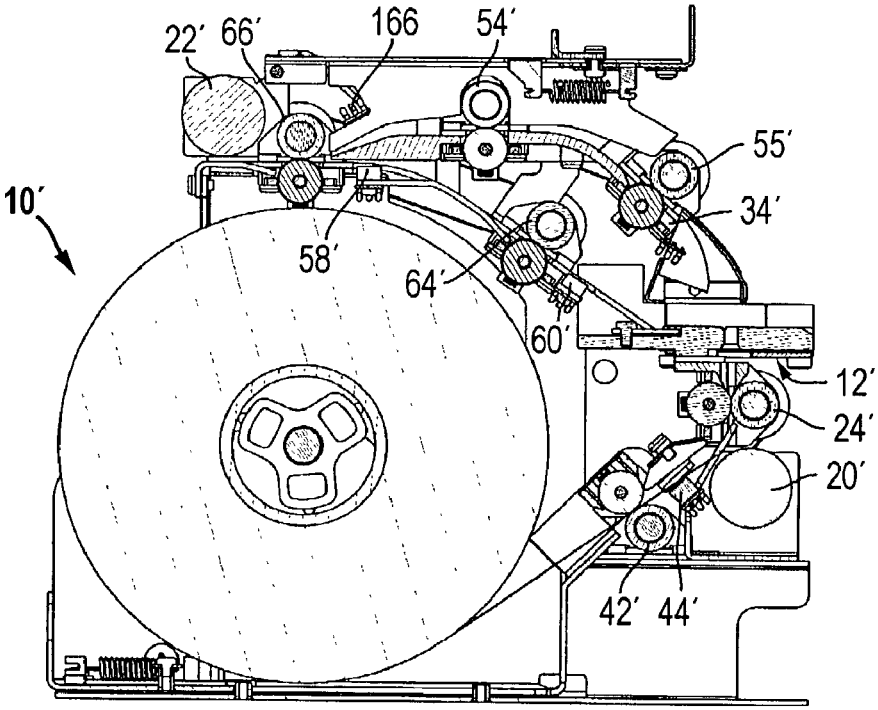
FIG. 23 is a right side section view of the apparatus shown in FIG. 22.
Figure 24:
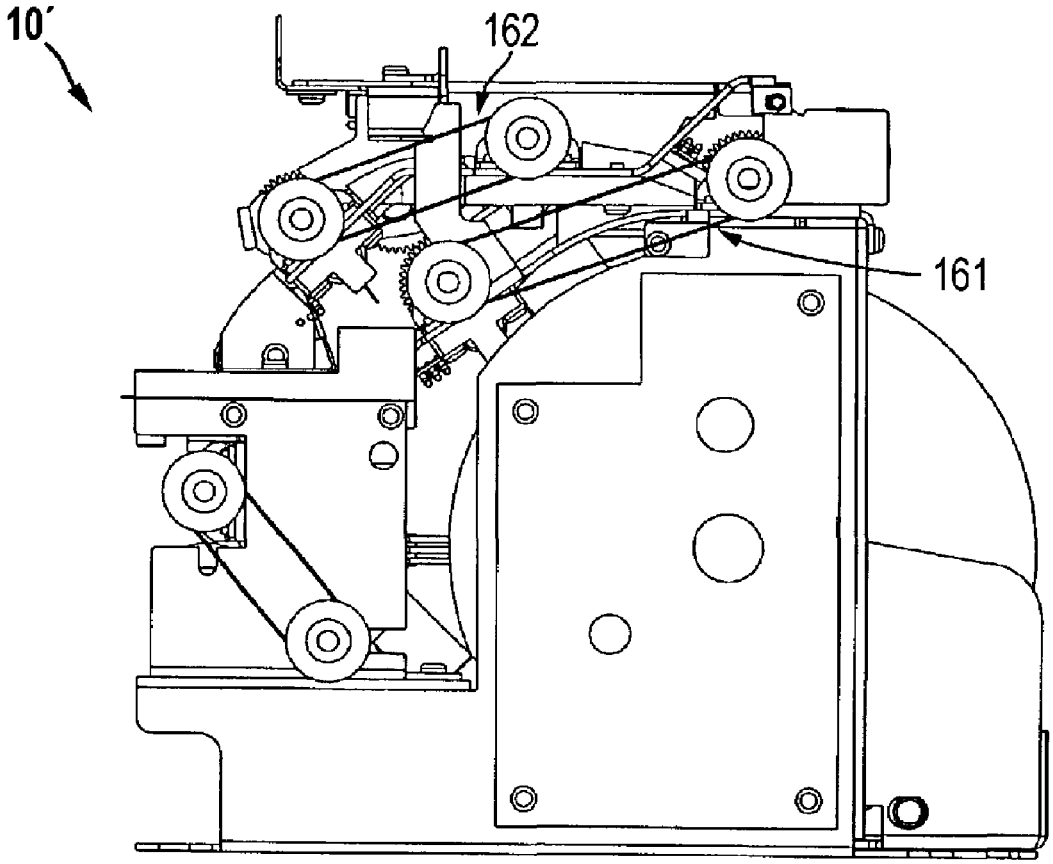
FIG. 24 is a left side view of the apparatus shown in FIG. 22.

In apparatus 10', the lower motor 20' and related rollers and gears operate generally the same as in the earlier described apparatus 10 shown in FIGS. 1 through 3. However, upper motor 22' in apparatus 10' is positioned adjacent to exit roller 66' as shown in FIG. 23. From this position, a drive gear 23' (shown in FIG. 22) associated with upper motor 22' may drive exit roller 66' through a gear 160 shown in FIG. 22 mounted on one end of exit roller 66'. Ticket roller 64' is shown in FIG. 23 and is driven through exit roller 66' with a pulley arrangement 161 shown in FIG. 24. FIG. 24 also shows a pulley arrangement 162. Pulley arrangement 162 links upper cover roller 54' to short cover roller 55' shown in FIG. 23 so that these rollers are driven in unison.

Figure 22:
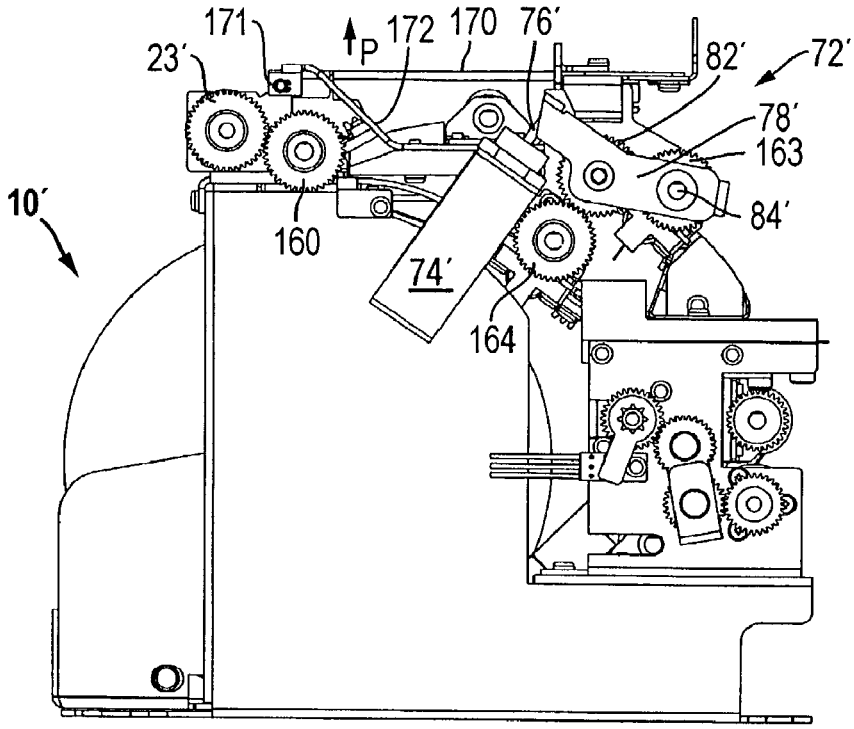
FIG. 22 is a right side view of an alternate apparatus embodying the principles of the invention for applying a cover to a ticket substrate.

Referring to FIG. 22, apparatus 10' also includes a cover roller disengagement arrangement 72' similar to arrangement 72 shown in FIG. 3. Cover roller disengagement arrangement 72' allows motor 22' in FIG. 23 to selectively drive short cover roller 55' through a gear 163 (FIG. 22) associated with roller 55'. When the arrangement 72' is in the position shown in FIG. 22, arm 78' places intermediate gear 82' in contact with gear 164 associated with ticket roller 64' (the roller being shown in FIG. 23). Thus, in this position the rotation of ticket roller 64' rotates gear 164, which in turn rotates intermediate gear 82' and gear 163 to rotate short cover roller 55' (the roller again being shown in FIG. 23). Activating the solenoid 74' to extend the plunger 76', however, would rotate arm 78' clockwise about pivot point 84', to take gear 82' out of engagement with gear 164 and prevent rollers 55' and 54' shown in FIG. 23 from rotating in unison with ticket roller 64' and exit roller 66'. Similarly to the disengagement arrangement 72 described above, arm 78' in arrangement 72' may be spring biased or otherwise biased counterclockwise about pivot point 84' to return the arm to the position shown in FIG. 22 regardless of the orientation of apparatus 10'.

Referring to FIG. 23, the arrangement of sensors in apparatus 10' is similar to that shown in FIG. 2 for apparatus 10. However, the position of paper sensor 44' is shifted somewhat with respect to paper sensor 44 shown in FIG. 2. Also, cover sensor 34' in apparatus 10' is shifted to a position ahead of short cover roller 55'. The sensor arrangement in apparatus 10' also includes an additional sensor 166 in position to detect the leading edge of a cover and stop the cover in the desired storage position.

Figure 25:
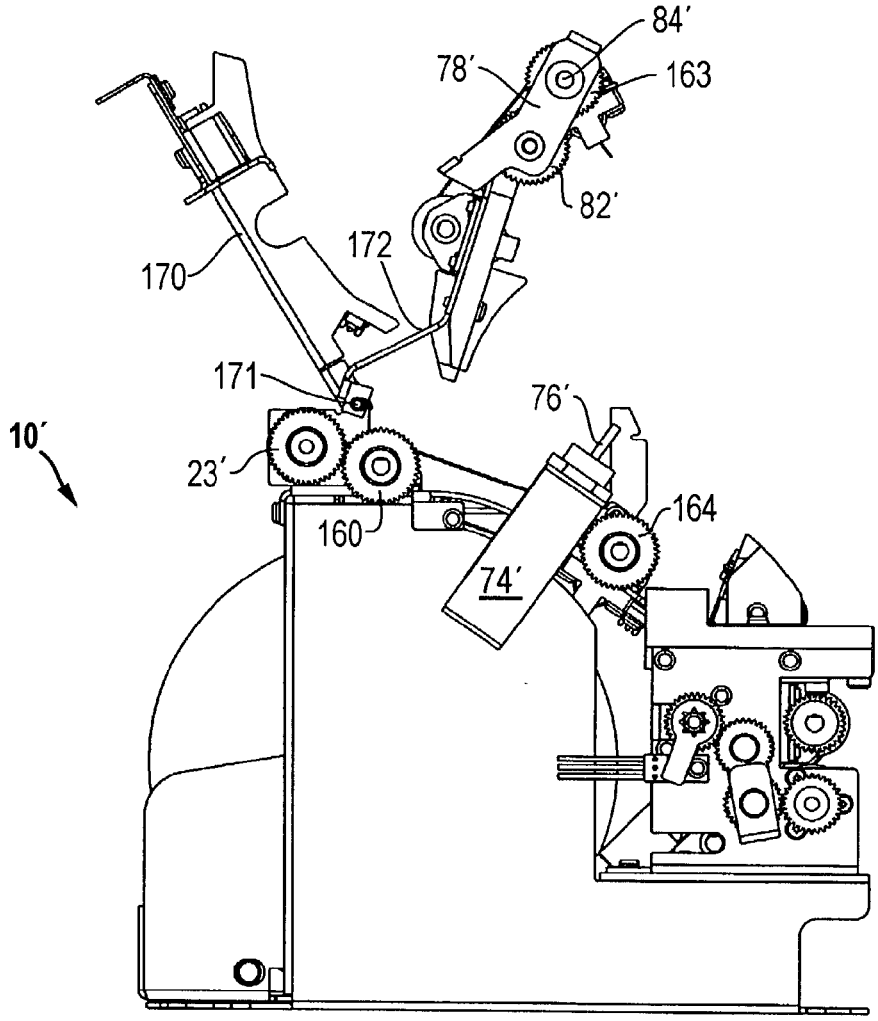
FIG. 25 is a right side view similar to FIG. 22, but with the certain components pivoted upwardly to provide access to the cover material and ticket path through the apparatus.

FIGS. 23 and 25 may be used to describe the cover and ticket path access arrangements included in apparatus 10'. The cover path access arrangement includes a guide structure 170 which is mounted at one end on a pivot device 171 so that the guide structure may be pivoted generally in the direction shown by arrow P in FIG. 23. The ticket path access arrangement includes a bracket 172 on which the upper cover roller 54' and short cover roller 55', and their respective companion rollers are mounted. This bracket 172 is also mounted so that it may be pivoted upwardly in the direction indicated by arrow P. It will be appreciated that pivoting guide structure 170 upwardly to the position shown in FIG. 25 provides access to a large portion of the cover path through apparatus 10'. Pivoting both structure 170 and bracket 172 to the position shown in FIG. 25 provides access to a large portion of the ticket path through apparatus 10'.

The above described preferred embodiments are intended to illustrate the principles of the invention, but not to limit the scope of the invention. Various other embodiments and modifications to these preferred embodiments may be made by those skilled in the art without departing from the scope of the following claims. For example, many different types of materials may be used for the cover material 16 including paper or plastic. Also, numerous different material conveying devices and cutting devices may be employed within the scope of the following claims. Also, although certain components have been described above using relative terms like "upper," "lower," or "middle," for example, it will be appreciated that these terms are used only for convenience and are not intended to limit the respective components to any relative position in the apparatus. Furthermore, it will be appreciated especially from FIGS. 2 and 23 that an apparatus according to the present invention includes numerous guide surfaces for guiding cover material and ticket substrates through the apparatus. These guide elements are shown in FIGS. 2 and 23 but their position is not otherwise described in this disclosure so as not to obscure the invention in unnecessary detail. Those skilled in the art will appreciate that many different guide arrangements may be used within the scope of the following claims for guiding the cover material and ticket substrates through the apparatus.

The invention claimed is:

1. An apparatus including:

(a) a cover mechanism for advancing a cover material along a cover material path to an applicator, and for advancing a gaming ticket substrate along a ticket substrate path to the applicator so that the ticket substrate path intersects the cover material path at a crossing point removed from the applicator; and (b) a gaming ticket printer for inserting the gaming ticket substrate into the cover mechanism along the ticket substrate path.

2. The apparatus of claim 1 wherein the gaming ticket printer is also for printing gaming indicia on the gaming ticket substrate.

3. The apparatus of claim 1 further including a control arrangement for controlling the movement of the cover material along the cover material path and for controlling the movement of the gaming ticket substrate along the ticket substrate path.

4. The apparatus of claim 3 wherein the control arrangement is also for sending a suppression signal to the gaming ticket printer where the suppression signal is for delaying the gaming ticket printer from inserting the gaming ticket substrate into the cover mechanism until a discrete section of cover material is in a storage position.

5. The apparatus of claim 3 further including a number of timers, each timer for providing an input signal to the control arrangement where the control arrangement uses the input signals from each of the timers to advance the cover material along the cover material path and to advance the gaming ticket substrate along the ticket substrate path in a way that prevents the cover material from being at the crossing point at the same time as the gaming ticket substrate.

6. The apparatus of claim 1 wherein the applicator applies a discrete section of cover material to the gaming ticket substrate so that the discrete section of cover material is removable from the gaming ticket substrate without substantially deforming the gaming ticket substrate.

7. The apparatus of claim 1 further including a ticket roller that is actuated in response to the gaming ticket substrate being inserted into the cover mechanism.

8. The apparatus of claim 7 wherein the ticket roller is for advancing the gaming ticket substrate along the ticket substrate path.

9. The apparatus of claim 1 further including a sensor arrangement.

10. The apparatus of claim 9 wherein the sensor arrangement includes a cover sensor in position to sense that a continuous length of cover material is in position to be severed by a cutter to produce a discrete section of cover material.

11. The apparatus of claim 9 wherein the sensor arrangement includes a cutter sensor in position to detect the completion of a cutting operation performed by a cutter.

12. The apparatus of claim 9 wherein the sensor arrangement includes a ticket sensor in position to sense that the gaming ticket substrate has been inserted into the cover mechanism along the ticket substrate path.

13. The apparatus of claim 9 wherein the sensor arrangement includes an exit sensor in position to detect the gaming ticket substrate at an input to the applicator.

* * * * *